US009701008B2

(12) United States Patent
Cho

(10) Patent No.: US 9,701,008 B2
(45) Date of Patent: Jul. 11, 2017

(54) BIT AND FASTENER HOLDER ASSEMBLY FOR A POWER TOOL

(71) Applicant: In Song Cho, Langley (CA)

(72) Inventor: In Song Cho, Langley (CA)

( * ) Notice: Subject to any disclaimer, the term of this patent is extended or adjusted under 35 U.S.C. 154(b) by 0 days.

(21) Appl. No.: 14/969,167

(22) Filed: Dec. 15, 2015

(65) Prior Publication Data

US 2016/0167219 A1 Jun. 16, 2016

Related U.S. Application Data

(60) Provisional application No. 62/092,134, filed on Dec. 15, 2014.

(51) Int. Cl.
*B25F 5/02* (2006.01)
*A45F 5/02* (2006.01)

(52) U.S. Cl.
CPC ..... *B25F 5/029* (2013.01); *A45F 5/02* (2013.01)

(58) Field of Classification Search
CPC ..... B25H 3/00; B25H 3/003; B25H 3/006; B25F 5/029; B25F 5/00; B25F 5/02
USPC ..... 206/349–379; 211/69.1, 70.6; 173/170, 173/171
See application file for complete search history.

(56) References Cited

U.S. PATENT DOCUMENTS 563,787 A 7/1896 Moyer
2,824,651 A 2/1958 Davis
2,842,260 A 7/1958 Molitor
3,204,776 A 9/1965 Brown et al.
3,213,335 A 10/1965 Bourne
3,236,366 A * 2/1966 Broda ..... B25H 3/003 206/379
3,405,377 A 10/1968 Pierce
3,886,508 A 5/1975 Lavrard
(Continued)

FOREIGN PATENT DOCUMENTS

DE 3514023 10/1986
DK 67590 9/1948
(Continued)

OTHER PUBLICATIONS

"Lutz Self-Adhesive Bit Holder", Oct. 28, 2014, as shown in the following WayBackMachine link: http://web.archive.org/web/20141028223217/http://www.rockler.com/lutz-self-adhesive-bit-holder.

(Continued)

*Primary Examiner* — Bryon Gehman
(74) *Attorney, Agent, or Firm* — Cameron IP

(57) ABSTRACT

There is provided a bit holder assembly for a power tool. According to a first aspect, the assembly comprises an elongate member shaped to extend around and selectively couple to a portion of the power tool. The assembly comprises a bit holder, a male member connected to the elongate member and a female member connected to the bit holder. According to a second aspect, the elongate member has a pair of longitudinal edges and the assembly comprises a mounting member connectable with the bit holder and having a pair of flanges each of which receives a respective one of the longitudinal edges of the elongate member. According to a third aspect, the power tool has a slot for receiving a belt clip adjacent to a bottom portion thereof and the assembly comprises a bracket connectable with the bit holder and the slot of the power tool.

20 Claims, 17 Drawing Sheets

(56) References Cited

U.S. PATENT DOCUMENTS

| | | | | |
|---|---|---|---|---|
| 4,013,109 | A * | 3/1977 | Sandel | A61B 17/06161 206/350 |
| 4,482,049 | A | 11/1984 | Kot, II | |
| 4,508,221 | A | 4/1985 | Olson | |
| 4,677,362 | A | 6/1987 | House, II et al. | |
| 4,797,040 | A | 1/1989 | Hibbard | |
| 4,826,059 | A | 5/1989 | Bosch et al. | |
| 4,828,154 | A | 5/1989 | Clifton, Jr. | |
| D314,699 | S | 2/1991 | Tamosaitis et al. | |
| 5,025,966 | A | 6/1991 | Potter | |
| 5,056,661 | A | 10/1991 | Balzano | |
| 5,080,230 | A | 1/1992 | Winnard | |
| 5,188,242 | A | 2/1993 | Smith | |
| 5,333,767 | A | 8/1994 | Anderson | |
| 5,343,181 | A | 8/1994 | Negus | |
| 5,456,359 | A | 10/1995 | Horn | |
| D369,078 | S | 4/1996 | Anderson | |
| D371,945 | S | 7/1996 | Geary et al. | |
| 5,535,882 | A * | 7/1996 | Liu | B25H 3/003 206/379 |
| 5,544,747 | A | 8/1996 | Horn | |
| 5,810,525 | A | 9/1998 | Ector, Sr. | |
| 5,842,584 | A | 12/1998 | Baird | |
| 6,033,163 | A | 3/2000 | Anderson | |
| 6,098,558 | A | 8/2000 | Baird | |
| 6,325,577 | B1 | 12/2001 | Anderson | |
| 6,356,176 | B1 | 3/2002 | Anderson | |
| 6,364,580 | B1 * | 4/2002 | Dils | B25F 5/00 206/379 |
| 6,496,094 | B2 | 12/2002 | May, III | |
| 6,502,949 | B1 | 1/2003 | Horiyama et al. | |
| 6,679,406 | B2 | 1/2004 | Sakai et al. | |
| 6,729,480 | B1 | 5/2004 | Blake | |
| 6,910,578 | B2 | 6/2005 | Stern | |
| 7,681,661 | B2 | 3/2010 | Sakai et al. | |
| 8,336,709 | B1 | 12/2012 | Geibel | |
| 8,376,199 | B2 | 2/2013 | Ellis | |
| 2002/0096545 | A1 | 7/2002 | Chang | |
| 2002/0179659 | A1 | 12/2002 | Shaw | |
| 2005/0242145 | A1 | 11/2005 | Wang | |
| 2006/0022002 | A1 | 2/2006 | Marks | |
| 2006/0104735 | A1 | 5/2006 | Zeiler et al. | |
| 2007/0175785 | A1 * | 8/2007 | Sharp | B25F 5/029 206/373 |
| 2007/0284405 | A1 * | 12/2007 | Prevost | A45F 5/02 206/379 |
| 2010/0219217 | A1 | 9/2010 | Andochick | |
| 2011/0088519 | A1 | 4/2011 | Hu | |
| 2014/0082850 | A1 | 3/2014 | Stokes et al. | |

FOREIGN PATENT DOCUMENTS

| | | |
|---|---|---|
| EP | 0456589 | 11/1991 |
| EP | 1344609 | 9/2003 |

OTHER PUBLICATIONS

"Holdsabit", Oct. 20, 2014, as shown in the following WayBackMachine link: http://web.archive.org/web/20141020214125/http://www.holdsabit.com/.

"Vermont American 15681 9 Bit Tip Assortment and Bit Tip Holder in Plastic Bandolier", Nov. 30, 2010, as shown in the following WayBackMachine link: http://web.archive.org/web/20101130120741/http://www.amazon.com/Vermont-American-15681-Assortment-Bandolier/dp/B00004YXBY.

"Custom Leathercraft 5023 Deluxe Cordless Poly Drill Holster", Nov. 3, 2013, as shown in the following WayBackMachine link: http://web.archive.org/web/20131103170815/http://www.amazon.com/Custom-Leathercraft-5023-Cordless-Holster/dp/B000LNM2H0.

"TEKTON 82157 Screwdriver Bit Set, 33-Piece", Nov. 29, 2013, as shown in the following WayBackMachine link: http://web.archive.org/web/20131129045523/http://www.amazon.ca/TEKTON-82157-Screwdriver-Bit-33-Piece/dp/B0038MBSBW.

"TEKTON 82157 Screwdriver Bit Set, 33-Piece", Sep. 3, 2012, as found on WayBackMachine (link unknown).

"Black & Decker 71-933 Magnetic Drive Guide Set, 31-Piece", Apr. 14, 2012, as shown in the following WayBackMachine link: http://web.archive.org/web/20120414150318/http://www.amazon.com/Black-Decker-71-933-Magnetic-31-Piece/dp/B0002STRAE?.

"Dewalt DWA2T4OIR Impact Ready FlexTorq Screw Driving Set", Oct. 25, 2014, as shown in the following WayBackMachine link: http://web.archive.org/web/20141025231220/http://www.amazon.com/DEWALT-DWA2T40IR-FlexTorq-Driving-40-Piece/dp/B00GMXFK3G.

"Bostitch BTC400LB 18-Volt Lithium-Ion Drill/Driver", Jun. 3, 2014, as shown in the following link: http://www.toolsnob.com/archives/2014/01/bostitch_btc400lb_18-volt_lith.php/.

"DeWalt Bit Holder for 20V Max Drill/Hammerdrill/Driver DCD 980 DCD985 DCD980L2 DCD985L2", Nov. 9, 2013, as shown in the following WayBackMachine link: http://web.archive.org/web/20131109060243/http://www.amazon.com/DeWalt-Holder-Hammerdrill-DCD980L2-DCD985L2/dp/B00737G9C6.

"Picquic 88911 Dual Screwdriver Set: Sixpac Plus and Stubby", Nov. 25, 2014, as shown in the following WayBackMachine link: http://web.archive.org/web/20141125052108/http://www.amazon.com/Picquic-88911-Dual-Screwdriver-Set/dp/B002UHBJDS.

"Stanley 66-358 Stanley Stubby Ratcheting MultiBit Screwdriver", Nov. 25, 2013, as shown at the following WayBackMachine link: http://web.archive.org/web/20131125002440/http://www.amazon.ca/Stanley-66-358-Ratcheting-MultiBit-Screwdriver/dp/B003HGH3YK.

"Stanley 66-358 Stanley Stubby Ratcheting MultiBit Screwdriver", May 14, 2013, as found on the WayBackMachine unknown).

"Drill Sergeant Magnetic Bit Holder", Mar. 29, 2014, as found on the following WayBackMachine link: http://web.archive.org/web/20140329144246/http://toolguyd.com/drill-sergeant-magnetic-bit-holder/.

"MagnoGrip 311-090 Magnetic Wristband", Dec. 31, 2013, as found on the following WayBackMachine link: http://web.archive.org/web/20131231013349/http://www.amazon.com/MagnoGrip-311-090-Magnetic-Wristband/dp/B000WU9LCQ.

"Half-Time Drill", Aug. 25, 2013, as found on the following WayBackMachine link: http://web.archive.org/web/20130825054139/http://www.amazon.com/Half-Time-Drill-HT011712/dp/B005CVCXRA.

"Dewalt DW2067 Torx Insert Bit Set, 7-Piece", Jul. 10, 2013, as shown in the following WayBackMachine link: http://web.archive.org/web/20130710040034/http://www.amazon.com/DEWALT-DW2067-Torx-Insert-7-Piece/dp/B0000DD6LV.

English Abstract of DE3514023.

English Abstract of DK67590.

Drill Sergeant Original Drill Bit Organizer—Power Drill Accessories—Amazon.com, May 26, 2014.

Strap-On Magnetic Scew Holder for Your Wrist by Fast Cap, http://fixmycabinet.com/2011/06/03/fast-cap-pro-hold-review/, May 26, 2014.

De Walt Bit Holder for 20V Max Drill/Hammerdrill/Driver DCD980 DCD985 DCD980L, http://www.amazon.com/DeWalt-Holder-Hammerdrill-DCD980L2-DCD985L2/dp/B007, May 26, 2014.

WORX Semi-Automatic Driver, http://www.lowes.ca/drills/worx-semi-automatic-driver_10336212.html?af=3632&cse=3 . . . , May 26, 2014.

Drill bit holder for electric & cordless drills, http://www.bit-grip.com/, May 26, 2014.

Amazon.com: MagnoGrip 311-090 Magnetic Wristband: Home Improvement, www.amazon.com/MagnoGrip-311-090-Magnetic-Wristband/do/B000WU9LCO/re . . . , May 26, 2014.

http://toolskool.com/wp-content/uploads/2013/09/PC-20V-4.jpg, May 26, 2014.

http://web.archive.org/web/20140329133153/http://www.magnogrip.com/, Mar. 29, 2014.

(56) References Cited

OTHER PUBLICATIONS http://web.archive.org/web/20131115043718/http://www.boschtools.com/Latest/NewProducts/Pages/ecbrushless.aspx?, dated Nov. 15, 2013.

* cited by examiner

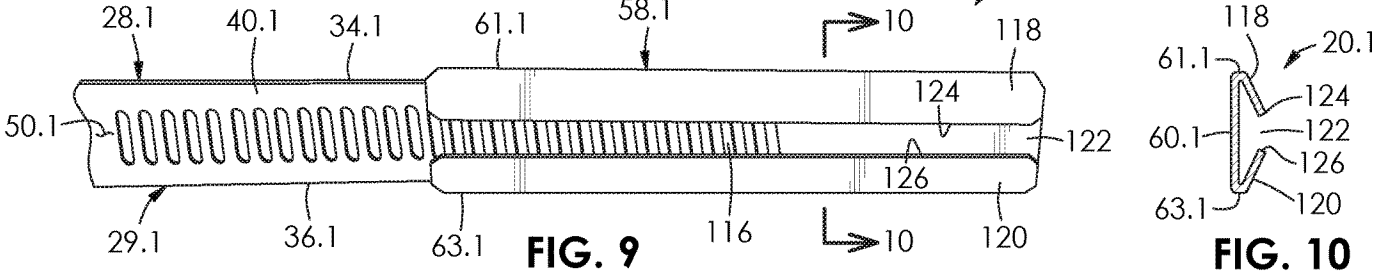
FIG. 10
FIG. 9
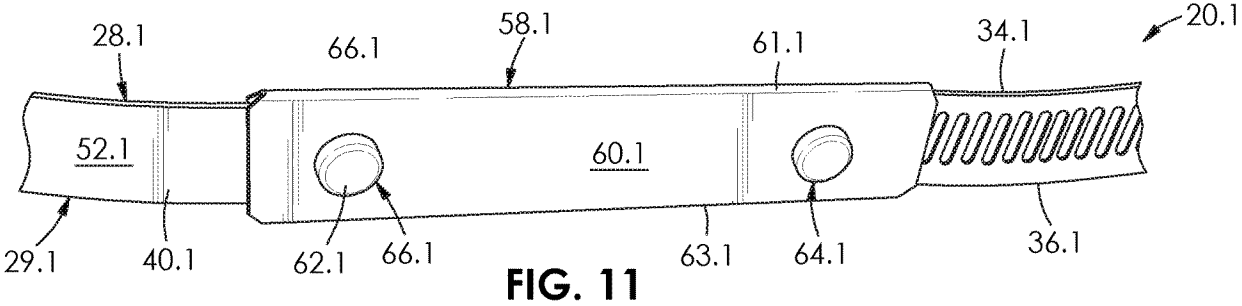
FIG. 11
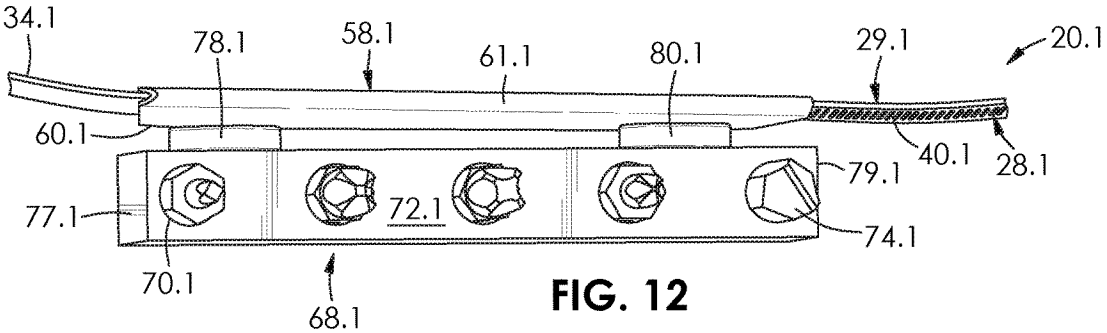
FIG. 12

BIT AND FASTENER HOLDER ASSEMBLY FOR A POWER TOOL

FIELD OF THE INVENTION

There is provided a bit and fastener holder assembly. In particular, there is provided a bit and fastener holder assembly for a power tool.

DESCRIPTION OF THE RELATED ART

United States Patent Application Publication No. 2006/0104735 to Zeller et al. discloses carrying systems, connecting systems and methods. The system connects a power tool and a component. In some constructions and in some aspects, the power tool includes a housing and a U-shaped receptacle defined by the housing. In some constructions and in some aspects, the component includes a stud selectively engageable with the receptacle to connect the power tool and the component. A locking mechanism is positioned within the receptacle and includes a cam. The locking mechanism is engageable with the stud to restrict movement of the stud with respect to the receptacle. The stud includes a recess at an end of the stud. The cam is selectively engageable with the recess to retain the stud within the receptacle. The cam is movable between a locked position and a released position. In the locked position, the cam extends into the recess and engages the stud. In the released position, the cam is retracted from the recess and is disengaged with the stud.

U.S. Pat. No. 6,496,094 to May, III discloses a magnet clamp for use with a hand tool. The patent discloses a magnet that can be reversibly attached to an existing commercially-available hand-held tool without modification of the tool. This thereby provides a way to securely hold various small metal items associated with said hand tool, while making said items readily available for use. Drill bits, saw blades, nails, screws, bolts, tacks, chuck keys, or any small objects made of or alloyed with a ferromagnetic substance such as iron or steel may be securely held by the magnet clamp. The device may be manufactured from common items, including an automotive hose clamp, and from common operations, such as soldering and gluing.

BRIEF SUMMARY OF INVENTION

There are accordingly provided herein improved bit and fastener holder assemblies for power tools.

According to one aspect, there is provided a bit holder assembly for a power tool. The assembly includes an elongate strap shaped to extend around and selectively couple to a portion of the power tool. The assembly includes a bit holder. The assembly includes a male member and a female member shaped to selectively receive and couple with the male member. A first one of the members operatively connects to and extends outwards from the strap. A second one of the members connects to and extends outwards from the bit holder.

According to another aspect, there is provided a bit holder assembly for a power tool. The assembly includes an elongate strap shaped to extend around and selectively couple to a portion of the power tool. The strap has a pair of longitudinal edge portions. The assembly includes a bit holder and a mounting member connectable with the bit holder. The mounting member has a pair of brackets each of which receives a respective one of the longitudinal edge portions of the strap.

According to a further aspect, there is provided a bit holder assembly for a power tool. The power tool has a slot for receiving a belt clip adjacent to a bottom portion thereof. The assembly includes a bit holder. The assembly includes a bracket connectable with the bit holder and the slot of the power tool.

There is yet additionally provided, in combination, a power tool and any one of the above set out bit holder assemblies.

BRIEF DESCRIPTION OF DRAWINGS

The invention will be more readily understood from the following description of preferred embodiments thereof given, by way of example only, with reference to the accompanying drawings, in which:

FIG. 9 is a rear elevation view of a strap and a mounting member for a magnetic bit and fastener holder assembly according to a second aspect, the strap being shown in fragment;

FIG. 10 is a sectional view taken along lines 10-10 of the mounting member of FIG. 9;

FIG. 11 is a front elevation view of the strap and mounting member of FIG. 9, the strap being shown in fragment;

FIG. 12 is a top perspective view of the strap and mounting member of FIG. 9 together with a bit holder of the assembly connected thereto, the strap being shown in fragment;

DESCRIPTION OF THE PREFERRED EMBODIMENTS

Figure 1:
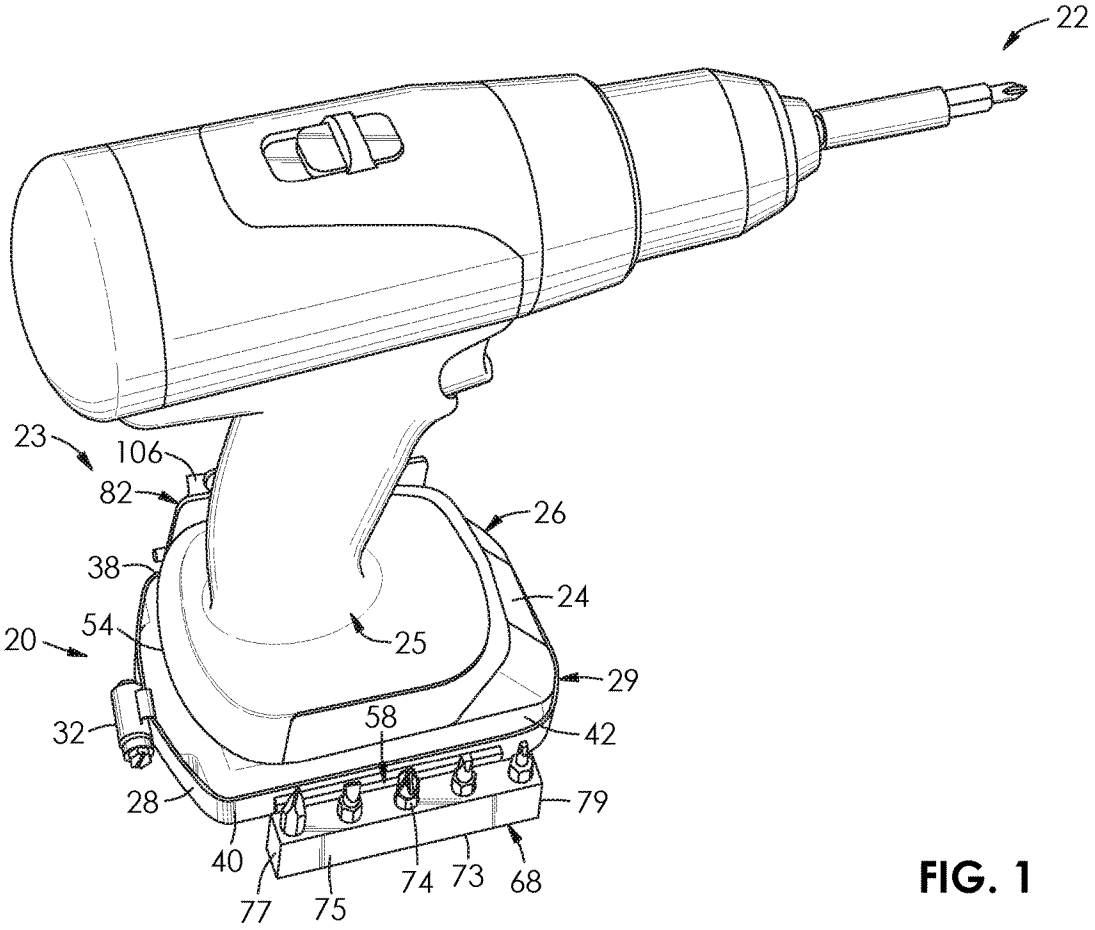
FIG. 1 is a top, side perspective view of a power tool together with a magnetic bit and fastener holder assembly connected thereto, according to a first aspect, the assembly including a strap, a mounting member connected thereto, a bit holder and a fastener holder.

Referring to the drawings and first to FIG. 1, there is shown a bit and fastener holder assembly 20 for a power tool 22. The power tool has a first side 23 and a second side 25 opposite the first side. The power tool 22 includes a battery pack 24 at a bottom portion 26 thereof. The power tool is a standard off-the-shelf rechargeable power drill in this example and is well known to those skilled in the art. Its parts and various functions will thus not be described in further detail.

Figure 2:
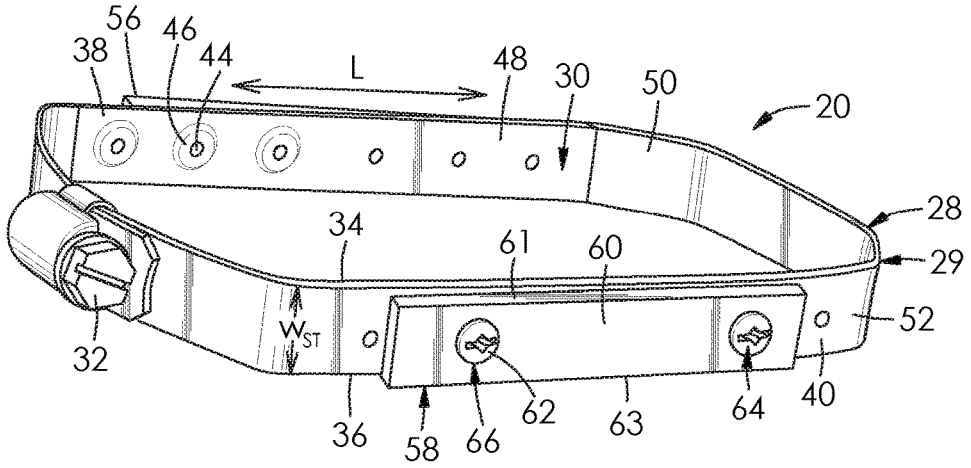
FIG. 2 is a side perspective view of the magnetic bit and fastener holder assembly of FIG. 1, with the bit holder and the fastener holder being removed and not shown.

The bit and fastener holder assembly 20 includes an elongate member, in this example a hose clamp 29. As seen in FIG. 2, the clamp includes a fastening strap 28 which is hoop-like in this example. The strap has a longitudinally-extending length L and a width WsT. The strap is generally rectangular in shape when viewed from the top in this example and extends around a central aperture 30. Referring back to FIG. 1, the strap 28 is shaped to selectively connect to and extend around a portion of the power tool 22, in this example, its battery pack 24. The hose clamp 29 has a fastening mechanism in this example in the form of a screw-type adjustment mechanism 32 for selectively adjusting the size of aperture 30 seen in FIG. 2.

As seen in FIG. 2, the strap 28 has a pair of spaced-apart sides 38 and 40 which extend in the longitudinal direction of the strap in this example. The sides of the strap are configured to abut and extend along spaced-apart sides of the battery pack. This is seen in FIG. 1 by side 40 of strap 28 abutting side 42 of the battery pack 24. Adjustment mechanism 32 is positioned between sides 38 and 40 of the strap and is located at a rear 54 of the battery pack 24. Side 38 of the strap aligns with side 23 of the power tool 22 in this example and side 40 of the strap aligns with side 25 of the power tool in this example. Referring back to FIG. 2, the strap 28 has a pair of longitudinal edges 34 and 36 that extend in parallel with the length L thereof.

There are a plurality of spaced-apart threaded apertures 44 extending through sides 38 and 40 of the strap. The apertures are spaced-apart along the lengths of the sides 38 and 40 of the strap. The apertures 44 in this example are the apertures of respective nuts 46 coupled to the sides of the strap via an elastomeric material, in this example electrical tape 48; alternatively, heat-shrinkable tubing may be used. The elastomeric material and/or tubing may promote enhanced coupling of the strap 28 to the power tool 22 and may inhibit scratching of the power tool. The nuts abut interior surfaces 50 of strap 28 in this example. Alternatively they may be embedded within the strap. The strap 28 includes an exterior surface 52 opposite its interior surface.

Referring to FIG. 2, the assembly 20 has a pair of spaced-apart mounting members 56 and 58 connected to the exterior surfaces 52 of respective ones of the sides 38 and 40 of the strap 28. Each of the mounting members is substantially the same in parts and functions in this example and thus only mounting member 58 will be described in detail. Each of the mounting members includes a mounting plate in this example, as shown by mounting plate 60 for member 58. The plates are elongated and rectangular prisms in shape in this example. Each of the mounting plates 60 has an upper peripheral edge portion 61 which is adjacent to and aligns with longitudinal edge 34 of strap 28. Each of the mounting plates has a lower peripheral edge portion 63 spaced-apart below portion 61 and which is adjacent to and aligned with longitudinal edge 36 of the strap.

The mounting plates 60 couple to respective ones of the sides of the strap via a pair of spaced-apart fasteners in this example, in this case in the form of bolts 62 and 64. The bolts extend through mounting plate 60 and couple with corresponding nuts 46. Each of the bolts has a head, or male member or protrusion, as shown by protruding head 66 for bolt 62. Thus, each of the mounting members in this example may be said to include a pair of spaced-apart male members or protrusions. The heads 66 of the bolts are hemispherical in shape in this example. However, this is not strictly required and the heads of the bolts may have other shapes in other embodiments.

Figure 4:
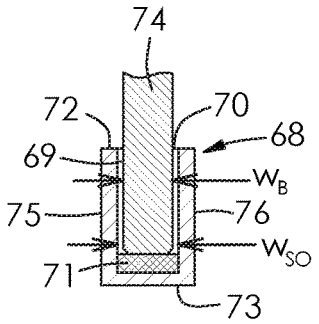
FIG. 4 is a cross-sectional view taken along lines 4-4 of the bit holder of FIG. 3.
Figure 8:
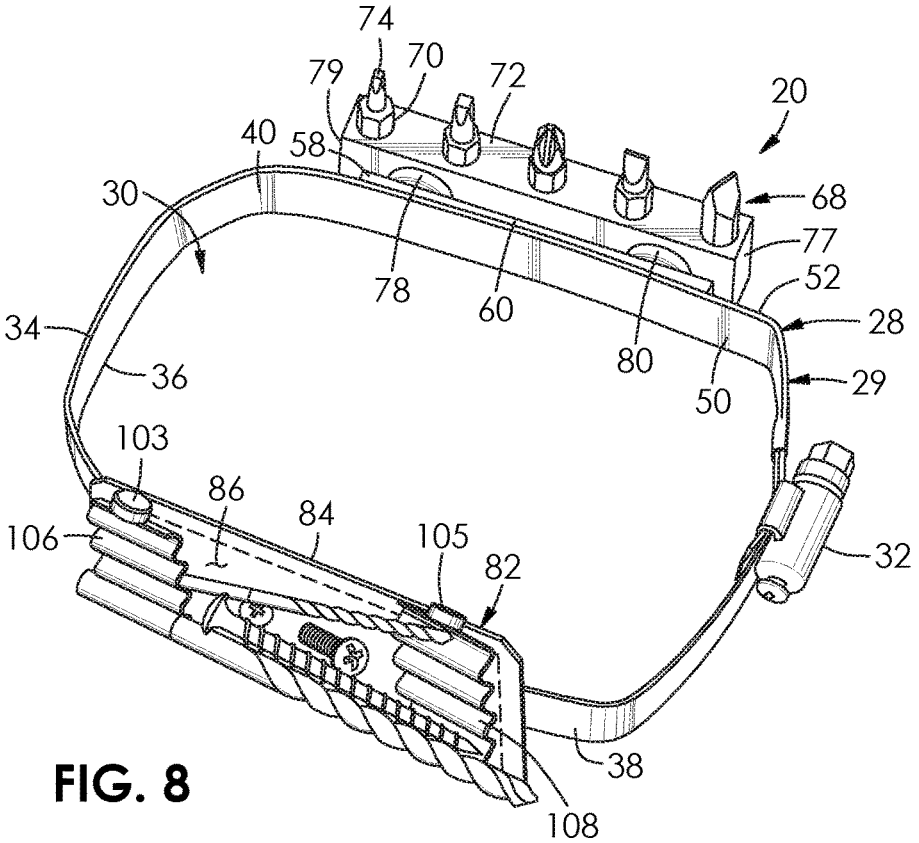
FIG. 8 is a top, side perspective view of the magnetic bit and fastener holder assembly of FIG. 1.

As seen in FIG. 1, the assembly 20 includes a first bit holder 68. The bit holder is a rectangular prism in shape in this example. Referring to FIG. 8, the bit holder 68 includes a plurality of longitudinally spaced-apart sockets 70 extending downwards from top 72 thereof. As seen in FIG. 4, each of the sockets 70 has an interior 69 and is shaped to receive a bit for the power tool 22, as shown by bit 74, within its interior. Each of the sockets 70 is slightly larger in cross-section than that of the bit 74 received therein. This is shown by socket 70 having a socket width $W_{SO}$ which is larger than the bit width $W_B$ of bit 74. This inhibits any friction between the bit and socket and enables the bit to be readily received within or removed from the socket.

The bit holder 68 is configured to be magnetic at least in part in this example such that the bits 74 may magnetically couple to the bit holder via the sockets. In this example, the first bit holder 68 includes a plurality of magnets disposed within respective ones of the sockets, as seen by magnet 71 disposed within interior 69 of socket 70 in FIG. 4. The magnets 71 are positioned adjacent to bottom 73 of the bit holder in this example. The magnets 71 are configured to magnetically couple with and hold in place respective ones of the bits 74. The magnets draw the bits thereto when the bits are positioned adjacent to the magnets.

Figure 3:
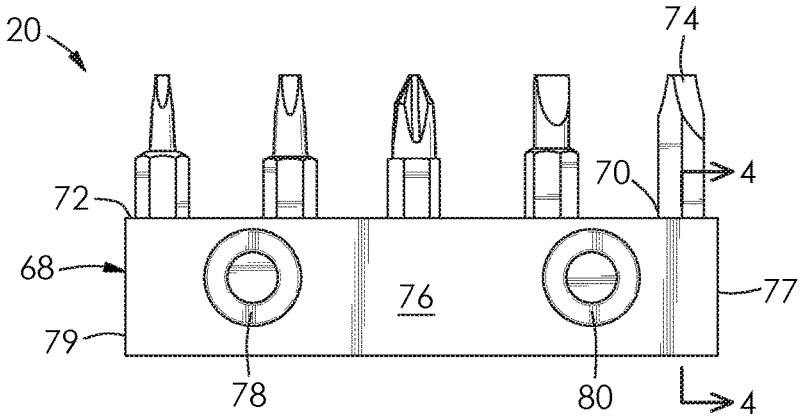
FIG. 3 is a rear elevation view of the bit holder of FIG. 1.

The top and bottom of the bit holder are rectangular in shape in this example. As seen in FIG. 1, the bit holder has a front 75 that faces outwards from the power tool 22. As seen in FIG. 3, the bit holder 68 includes a rear 76 opposite the front thereof. The front and rear are rectangular in this example and extend between the top 72 and bottom 73 of the bit holder. The rear 76 of the bit holder 68 is configured to face and abut its corresponding mounting plate 60 seen in FIG. 2. As seen in FIG. 1, the bit holder has a pair of ends 77 and 79 which extend between front 75 and rear 76 thereof and which extend between top 72 and bottom 73 thereof. The ends of the bit holder are rectangular in this example.

As seen in FIG. 3, the assembly 20 includes a pair of spaced-apart female members that are annular members in this example, and in this case in the form of washers 78 and 80. The washers are coupled to and extend from the rear 76 of the bit holder 68. The washers 78 and 80 are made of metal and are ferromagnetic in this example. The washers are shaped to selectively receive and magnetically connect to respective ones of the heads 66 of the bolts 62 and 64 seen in FIG. 2. In this manner, bit holder 68 seen in FIG. 3 may selectively connect to one of the sides 38 and 40 of the strap 28. As seen in FIG. 1, the bit holder may thus selectively connect to the battery pack 24 of power tool 22 at side 25 of the power tool 22 in this example. The bit holder 68 so shaped and configured thus extends along and in parallel with side 25 of the power tool in a compact manner.

Figure 5:
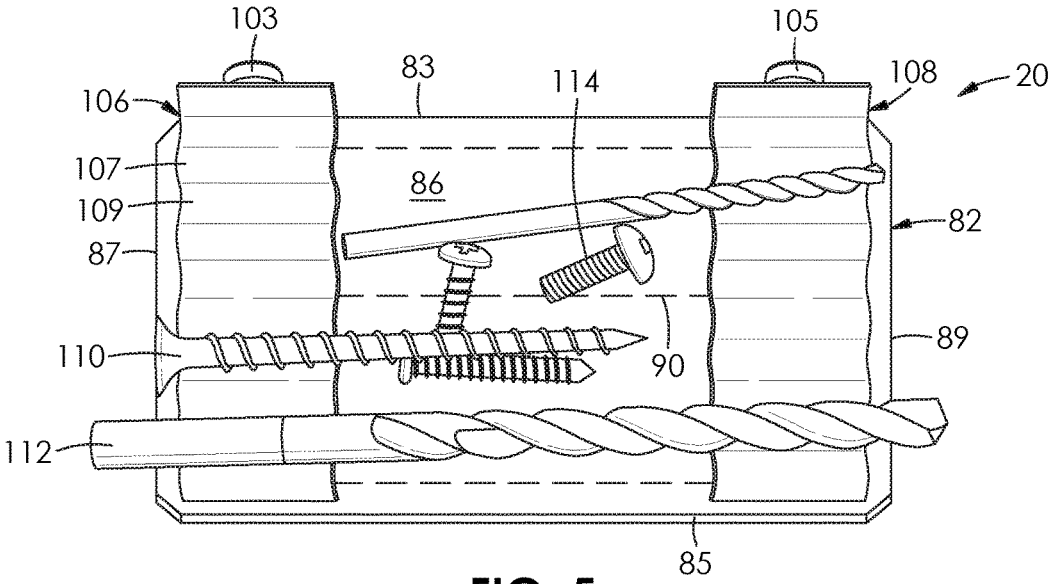
FIG. 5 is a front elevation view of the fastener holder of FIG. 1.
Figure 6:
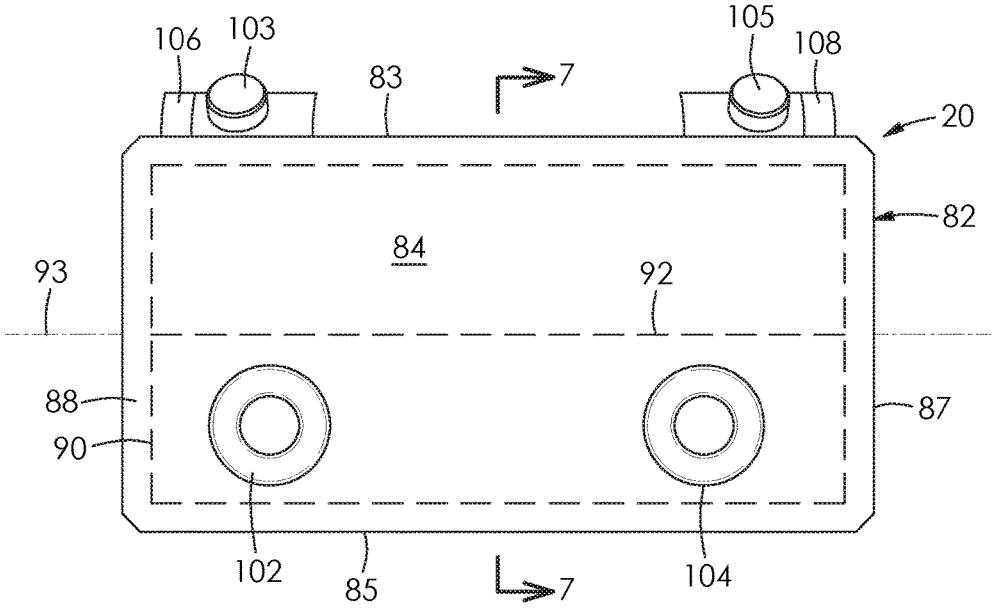
FIG. 6 is a rear elevation view of the fastener holder of FIG. 5.

Referring now to FIGS. 5 and 6, the assembly 20 includes a second holder, which is capable of holding either a bit or fastener and which may thus be referred to either a bit holder or a fastener holder, but which in this case will be referred to as a fastener holder 82 going forward. As seen in FIG. 5, the fastener holder has a top 83, bottom 85 spaced-apart from the top, and a pair of spaced-apart ends 87 and 89.

Referring to FIG. 6, the fastener holder includes an inner portion 84 configured to face the strap 28 of the assembly 20 as seen in FIG. 8. The fastener holder 82 includes an outer portion 86, best seen in FIG. 5, which is coupled to the inner portion. Each of the inner and outer portions of the fastener holder 82 is rectangular in profile in this example and made of fabric in this example.

Figure 7:
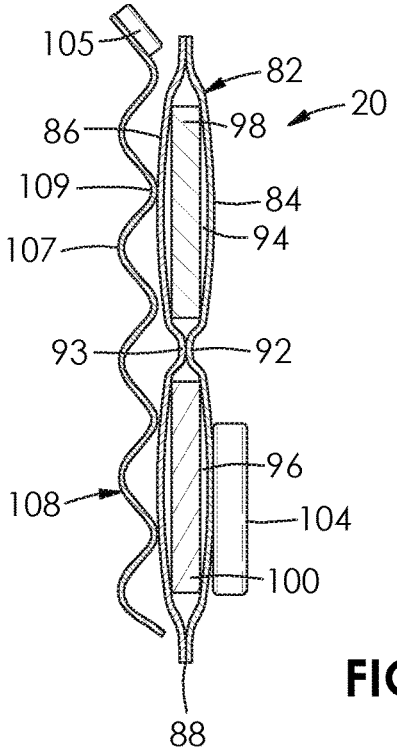
FIG. 7 is a sectional view taken along lines 7-7 of the fastener holder of FIG. 6.

As seen in FIG. 7, the peripheral portions 88 of the inner and outer portions 84 and 86 are coupled together in this example via stitching 90 shown in FIG. 6. Stitching 92 connects inner and outer portions 84 and 86 together along the longitudinal centerline 93 of the holder 82. As seen in FIG. 7, the fastener holder 82 includes a pair of longitudinally-extending interior regions 94 and 96 located above and below stitching 92. The assembly 20 includes a pair of longitudinally extending magnets, in this case an upper magnet 98 and lower magnet 100 in this example. The magnets are positioned within respective ones of interior regions 94 and 96 of the fastener holder 82. The magnets are rectangular prisms in shape in this example. The magnets 98 and 100 are thus interposed between the inner portion 84 and outer portion 86 of the fastener holder 82. The magnets are shown in ghost in FIG. 6 and extend between sides 87 and 89.

As seen in FIG. 6, the assembly 20 includes a further pair of spaced-apart female members which are annular members in this example, in this case in the form of washers 102 and 104. The washers are coupled to and extend outwards from the inner portion 84 of the fastener holder 82. The washers 102 and 104 are made of metal and are ferromagnetic in this example. As seen in FIG. 7, the washers align with and are spaced-apart along lower magnet 100 in this example. The washers 102 and 104 magnetically couple to the inner portion 84 of the fastener holder 82 and are positioned in place thereon via the lower magnet in this example. Each of the washers is shaped to selectively receive and magnetically connect to one of the heads 66 of the bolts 62 and 64 seen in FIG. 2. In this manner, fastener holder 82 seen in FIGS. 5 and 6 may selectively connect to another of the sides 38 of the strap 28 seen in FIG. 8. The fastener holder may thus selectively operatively connect to the battery pack 24 of power tool 22 seen in FIG. 1 at side 23 of the power tool 22 in this example. The fastener holder 82 so shaped and configured thus extends along and in parallel with side 23 of the power tool in a compact manner.

As seen in FIG. 5, the fastener holder 82 further comprises a pair of longitudinally spaced-apart corrugated metal sheets 106 and 108 in this example. The sheets are coupled to and extend outwards from the outer portion 86 of the fastener holder. The sheets 106 and 108 extend from top 83 to bottom 85 of the fastener holder. Sheet 106 is positioned adjacent to end 87 of the fastener holder 82 in this example and sheet 108 is positioned adjacent to end 89 of the fastener holder. The sheets are ferromagnetic in this example. The sheets 106 and 108 have magnets 103 and 105 coupled thereon adjacent to top 83 of the fastener holder 82 in this example. The magnets are generally cylindrical in shape in this example.

The sheets 106 and 108 include a plurality of spaced-apart outwardly-convex protrusions 107 and concave channels 109 interposed between respective ones of said channels. The sheets are rectangular in profile in this example and are shaped to receive a plurality of fasteners and bits thereon within their channels 107 and/or therebetween. This is seen in FIG. 5 by fastener 110 being received within a respective one of the channels 109 of sheet 106 and by drill bit 112 being received within respective ones of the channels of sheets 106 and 108. Fasteners and bits may also couple directly to the outer portion 86 of the fastener holder 82, as shown by fastener 114 thereon which is magnetically coupled to the outer portion of the fastener holder 82 via magnet 98 seen in FIG. 7.

FIGS. 9 to 12 show a magnetic bit and fastener holder assembly 20.1 according to a second aspect for the power tool 22 seen in FIG. 1. Like parts have like numbers and functions as the assembly 20 shown in FIGS. 1 to 8 with the addition of decimal extension "0.1". Assembly 20.1 is substantially the same as the assembly 20 shown in FIGS. 1 to 8 with the following exceptions.

Each of the mounting members 58.1 of the assembly 20.1 is sleeve-like and shaped to extend at least partially around a portion 116 of the strap 28.1. Each mounting member in this case includes an upper flange 118 which couples to and extends downwards from the upper peripheral edge portion 61.1 thereof. Each mounting member 58.1 includes a lower flange 120 which couples to and extends upwards from the lower peripheral edge portion 63.1 thereof. As seen in FIG. 10, the flanges 118 and 120 are v-shaped in cross-section and are integrally connected to and formed with mounting plate 60.1 in this example. As seen in FIG. 10, each mounting member 58.1 is thus c-shaped in lateral cross-section. Referring to FIG. 9, an elongate, longitudinally extending slot 122 extends between distal ends 124 and 126 of the flanges 118 and 120. As seen in FIG. 9, the mounting plate and flanges are shaped to receive respective ones of the longitudinal edges 34.1 and 36.1 of strap 28.1. The mounting members 58.1 so shaped are selectively extendable about the strap and slidably moveable along the length L.1 of the strap.

Figure 13:
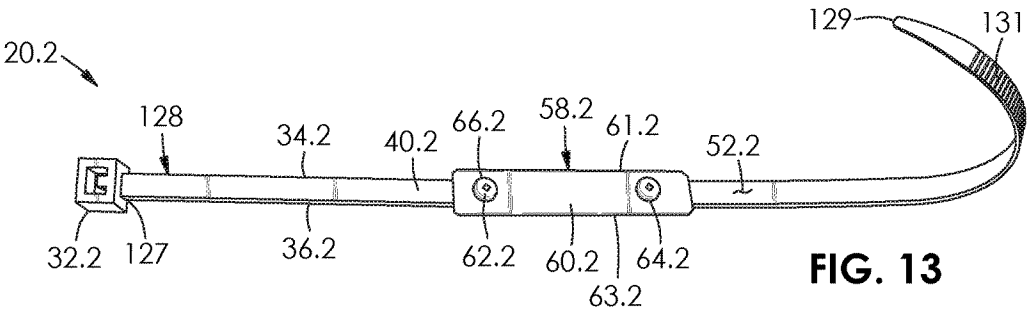
FIG. 13 is a front elevation view of a strap and a mounting member for a magnetic bit and fastener holder assembly according to a third aspect, the strap being shown in fragment.
Figure 14:
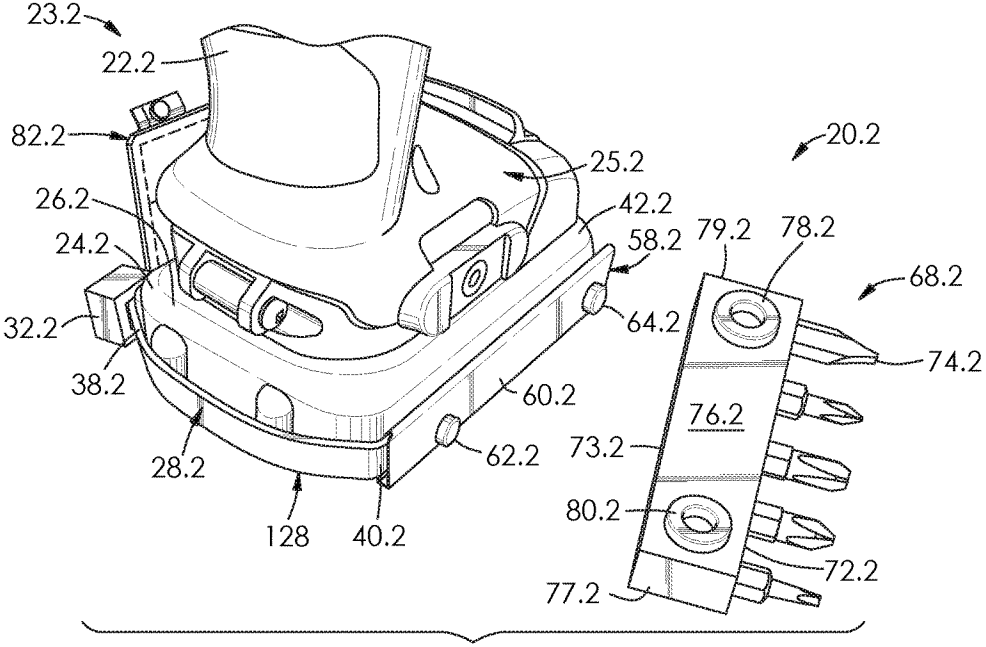
FIG. 14 is a top, side perspective view of a power tool and the magnetic bit and fastener holder assembly of FIG. 13, with the bit holder laying on its side and being spaced-apart from the mounting member and with the power tool being shown in fragment.

FIGS. 13 and 14 show a magnetic bit and fastener holder assembly 20.2 for a power tool 22.2 according to a third aspect. Like parts have like numbers and functions as the assembly 20.1 shown in FIGS. 9 to 12 with decimal extension "0.2" replacing decimal extension "0.1". Assembly 20.2 is substantially the same as the assembly 20.1 shown in FIGS. 9 to 12 with the exception that, instead of a hose clamp, strap 28.2 is part of a cable tie 128.

The cable tie has a fastening mechanism in the form of a pawl 32.2 at a first end 127 of the cable. The cable has a free, second end 129 spaced-apart from end 127. Strap 28.2 includes a plurality of longitudinally spaced-apart, laterally extending protrusions, in this example gear racks 131 spaced between ends 127 and 129 as seen in FIG. 13. The cable tie 128 extends about battery pack 24.2 and free end 129 thereof is selectively insertable through the pawl 32.2, with the pawl engaging selective ones of the gear racks in a ratchet manner to couple the cable tie to the bottom portion 26.2 of the power tool 22.2.

FIGS. 15 to 22 show a magnetic bit and fastener holder assembly 20.3 according to a fourth aspect. Like parts have like numbers and functions as the assembly 20 shown in FIGS. 1 to 8 with the addition of decimal extension "0.3". Assembly 20.3 is substantially the same as the assembly 20 shown in FIGS. 1 to 8 with the following exceptions.

Figure 16:
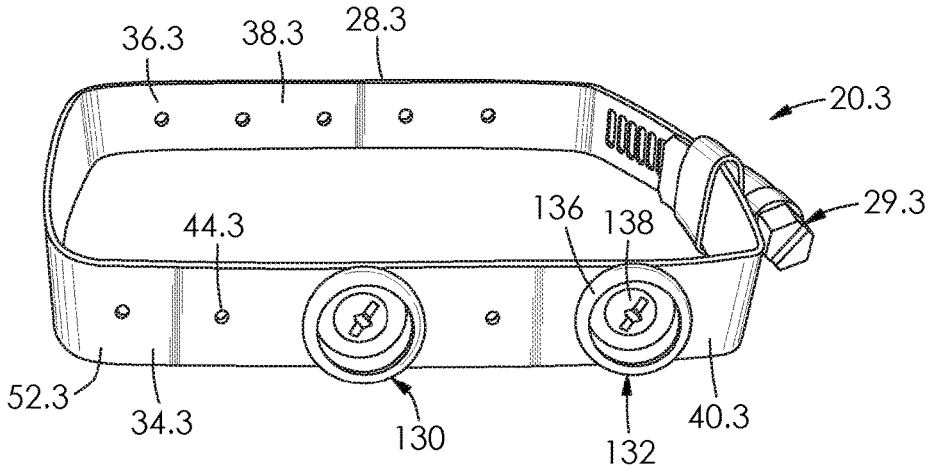
FIG. 16 is a top, side perspective view of the strap of the assembly of FIG. 15.
Figure 17:
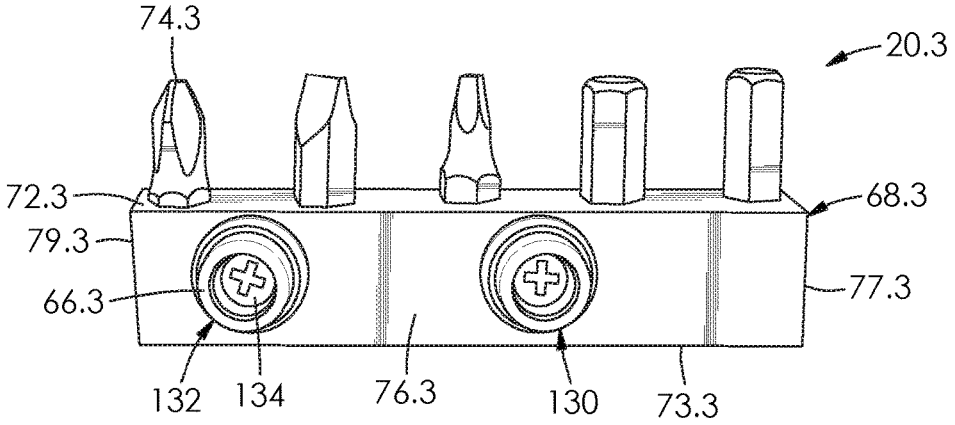
FIG. 17 is a rear, top perspective view of the bit holder of the assembly of FIG. 15.

In this case, bit holder 68.3 seen in FIG. 17 selectively couples to strap 28.3 seen in FIG. 16 via spaced-apart snap fasteners 130 and 132 located along side 40.3 of the strap. Each snap fastener comprises a male member or snap fastener stud, and a female member or snap socket shaped to selectively receive the male member. The snap fasteners are made of stainless steel in this example. This is seen in FIG. 17 by snap fastener stud 66.3 coupled to rear 76.3 of bit holder 68.3 via fastener 134 in FIG. 17, and in FIG. 16 by snap socket 136 coupled to exterior surface 52.3 of strap 28.3 via fastener 138 in FIG. 16.

Figure 18:
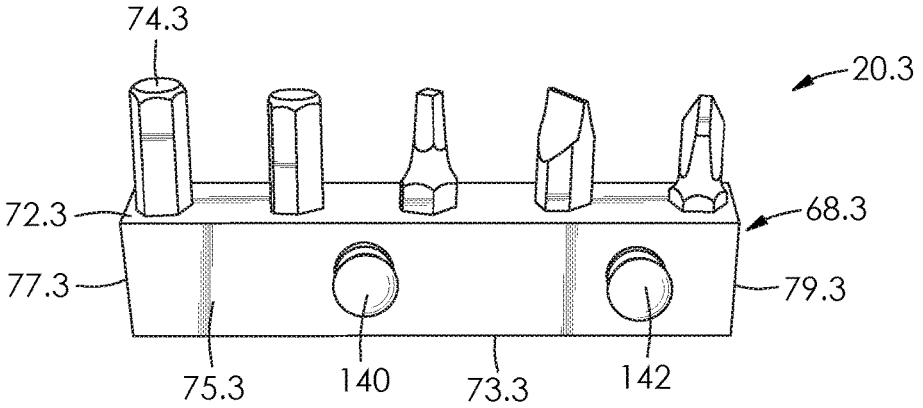
FIG. 18 is a front, top perspective view of the bit holder of the assembly of FIG. 15.

As seen in FIG. 18, the assembly 20.3 includes a pair of spaced-apart male members, in this example protrusions or knobs 140 and 142 which are magnetic. The knobs couple to and extend outwards from the front 75.3 of bit holder 68.3. The knobs are partially spherical in this example. As seen with reference to FIGS. 17 and 18, knob 140 axially aligns with and is opposite fastener 132 in this example and knob 142 axially aligns with and is opposite fastener 130.

Figure 19:
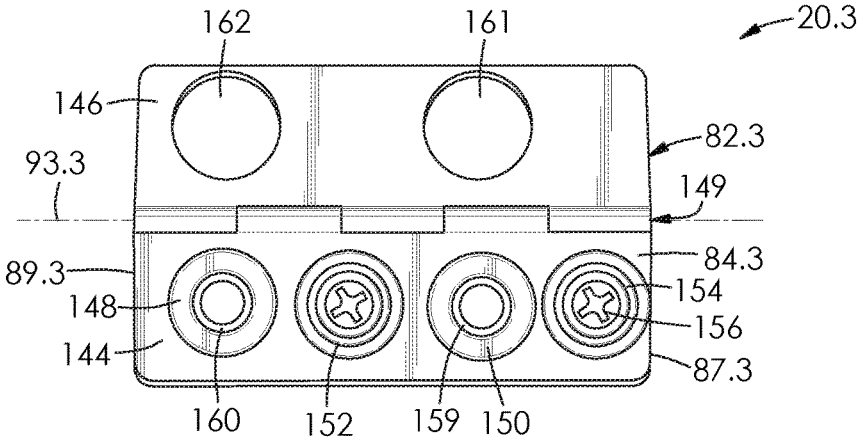
FIG. 19 is a rear elevation view of the fastener holder of the assembly of FIG. 15, the fastener holder being shown in an open, fully unfolded position.
Figure 20:
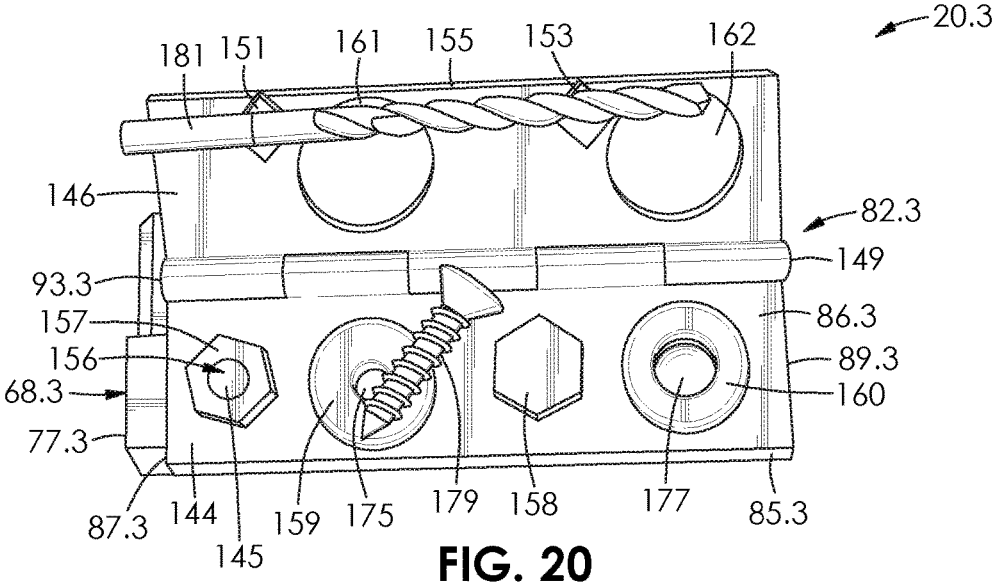
FIG. 20 is a front elevation view of the fastener holder of the assembly of FIG. 15, the fastener holder being shown in an open, partially unfolded position and being shown coupled to the bit holder of the assembly of FIG. 15.
Figure 21:
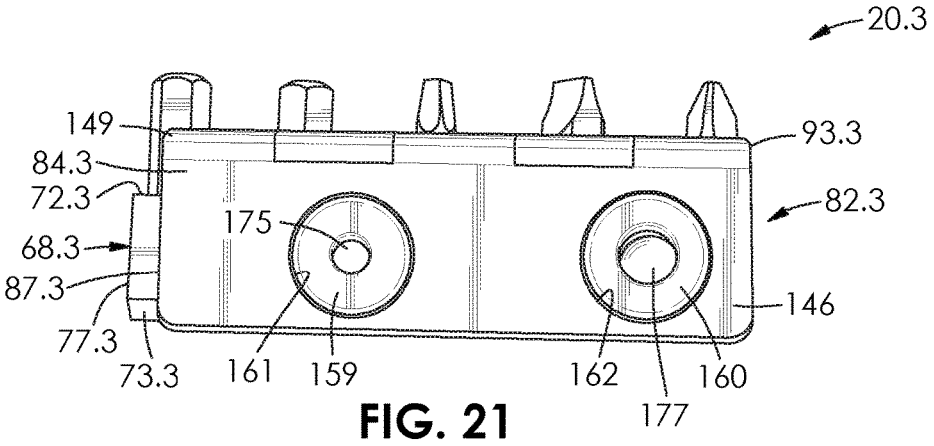
FIG. 21 is a front elevation view of the fastener holder of the assembly of FIG. 15, the fastener holder being shown in the closed, folded position and being shown coupled to the bit holder of the assembly of FIG. 15.

As seen in FIGS. 19 to 21, assembly 20.3 includes a foldable fastener holder 82.3 for temporary storage of metal screws, nails, washers, bolts, nuts, bit tip holders, drills and the like. The holder comprises a pair of elongate members 144 and 146 hingedly connected together via hinge 149 located at centerline 93.3. The elongate members are flat, rectangular and rigid plates made of metal which is ferromagnetic, in this example. Fastener holder 82.3 is moveable from a folded position seen in FIG. 21, in which the elongate members 144 and 146 overlie each other, to a partially unfolded position seen in FIG. 20, in which the elongate members are angularly spaced-apart relative to each other.

As seen in FIG. 19, inner portion 84.3 of elongate member 144 is shaped to selectively magnetically couple to the knobs 140 and 142 of bit holder 68.3 seen in FIG. 18 via a pair of spaced-apart female members, in this example annular members, in this case washers 148 and 150. The washers are made of metal and are ferromagnetic in this example. As seen in FIG. 19, washer 148 is positioned adjacent to end 89.3 of the fastener holder 82.3 in this example.

The inner portion 84.3 of elongate member 144 also includes a pair of spaced-apart male members, in this case snap fastener studs 152 and 154. These snap fastener studs are configured to selectively connect directly to the snap fastener sockets 136 of the snap fasteners 130 and 132 of the strap 28.3 seen in FIG. 16. The snap fastener studs 152 and 154 are coupled to elongate member 144 via fasteners 156 in this example. As seen in FIG. 19, snap fastener stud 154 is positioned adjacent to end 87.3 of the fastener holder 82.3 in this example. Snap fastener stud 152 is interposed between washers 148 and 150 in this example and washer 150 is interposed between snap fastener studs 152 and 154. Fastener holder 82.3 is thus configured in this example to have an alternating arrangement of respective washers and snap fastener studs coupled to and extending outwards from the inner portion 84.3 of elongate member 144.

Figure 15:
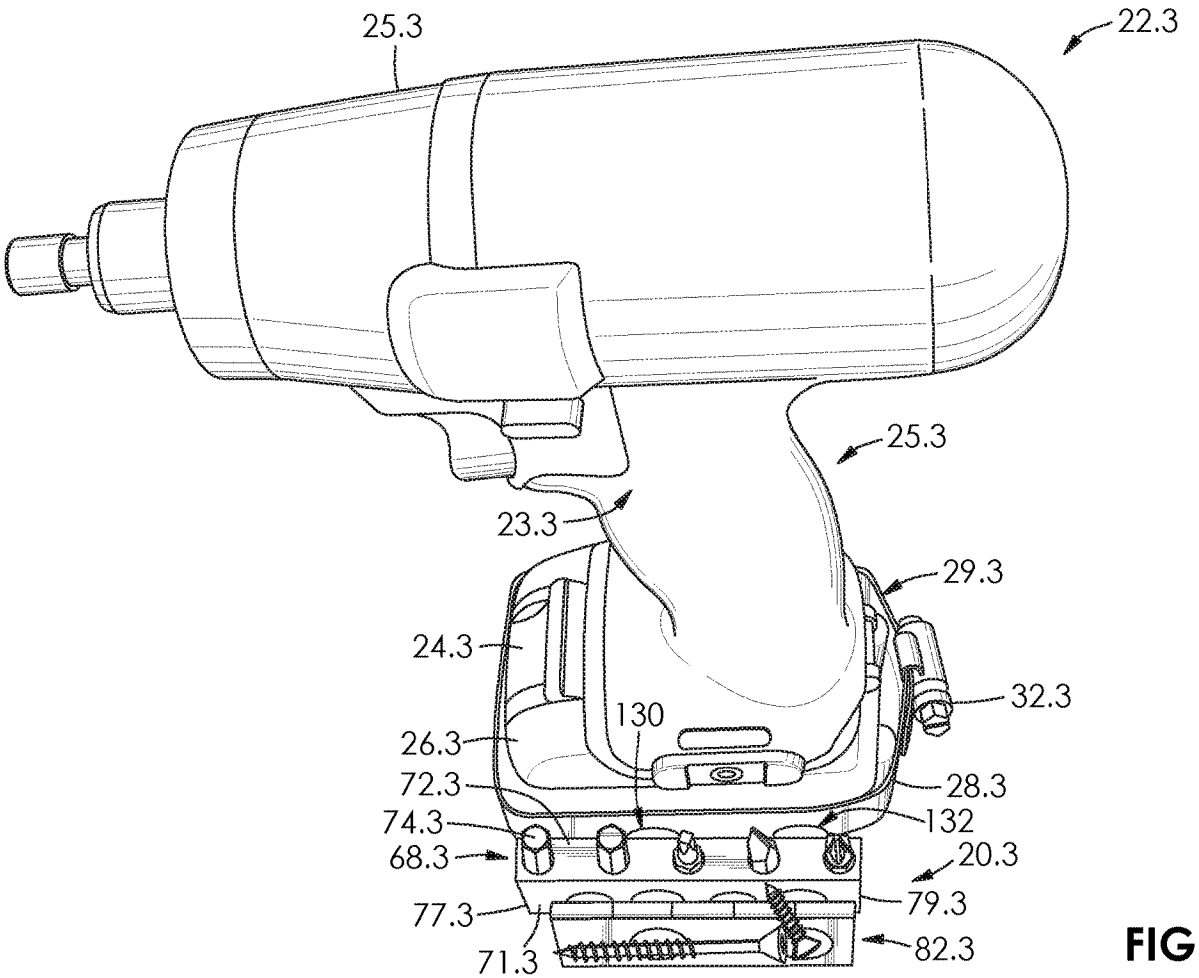
FIG. 15 is a top, side perspective view of a power tool together with a bit and fastener holder assembly connected thereto, according to a fourth aspect, the assembly including a strap, a bit holder and a fastener holder, the fastener holder being shown in a closed, folded position.

Thus, as seen in FIG. 15, fastener holder 82.3 in this embodiment is configured to either selectively couple to bit holder 68.3 via washers 148 and 150 of the fastener holder seen in FIG. 19 coupling to knobs 140 and 142 of the bit holder seen in FIG. 18, or alternatively selectively couple directly to strap 28.3 via snap fastener studs 152 and 154 of the fastener holder seen in FIG. 19 coupling to snap fastener sockets 136 of the strap. The former may be useful, for example, where a work task requires many fasteners and frequent changing of bits, whereas the latter may be useful, for example, for a work task in which only one bit is needed.

Referring to FIG. 20, the assembly 20.3 includes a pair of spaced-apart nuts 157 and 158 abutting the outer portion 86.3 of elongate member 144 of the fastener holder 82.3 in this example. The nuts 157 and 158 couple to the threaded ends 145 of respective ones of the fasteners 156 which position in place the snap fastener studs 152 and 154 seen in FIG. 19 in this example. As seen in FIG. 20, nut 157 is positioned adjacent to end 87.3 of the fastener holder 82.3 in this example.

The elongate member 144 includes a further pair of annular members, in this example annular magnets 159 and 160 coupled to and extending outwards from the outer portion 86.3 thereof. As seen in FIG. 20, the magnets are configured to receive fasteners 179 and the like. Magnet 159 has a centrally-disposed circular aperture 175 extending therethrough in this example and magnet 160 has a centrally-disposed circular aperture 177 extending therethrough. Aperture 175 is smaller than aperture 177 in this example. Magnet 160 is positioned adjacent to end 89.3 of the fastener holder 82.3 in this example and is axially aligned adjacent to and opposite washer 148 seen in FIG. 19. Referring back to FIG. 20, magnet 159 is interposed between nuts 157 and 158 in this example and is axially aligned adjacent to and opposite washer 150 seen in FIG. 19. As seen in FIG. 20, nut 158 is interposed between magnets 159 and 160.

As seen in FIG. 20, fastener holder 82.3 includes a pair of spaced-apart magnets 151 and 153 coupled to elongate member 146 of the fastener holder 82.3 and aligned along upper peripheral edge portion 155 thereof. Each of the magnets is a rectangular prism in shape in this example and is configured to couple with drill bits 181 according to one preferred example; however, the magnets may also receive bit tip holders, fasteners and the like. The magnets are positioned such that when the fastener holder 82.3 is in its folded position seen in FIG. 21, magnet 151 seen in FIG. 20 is adjacent to and interposed between nut 156 and magnet 175, and magnet 153 is adjacent to and interposed between nut 158 and magnet 160.

Figure 22:
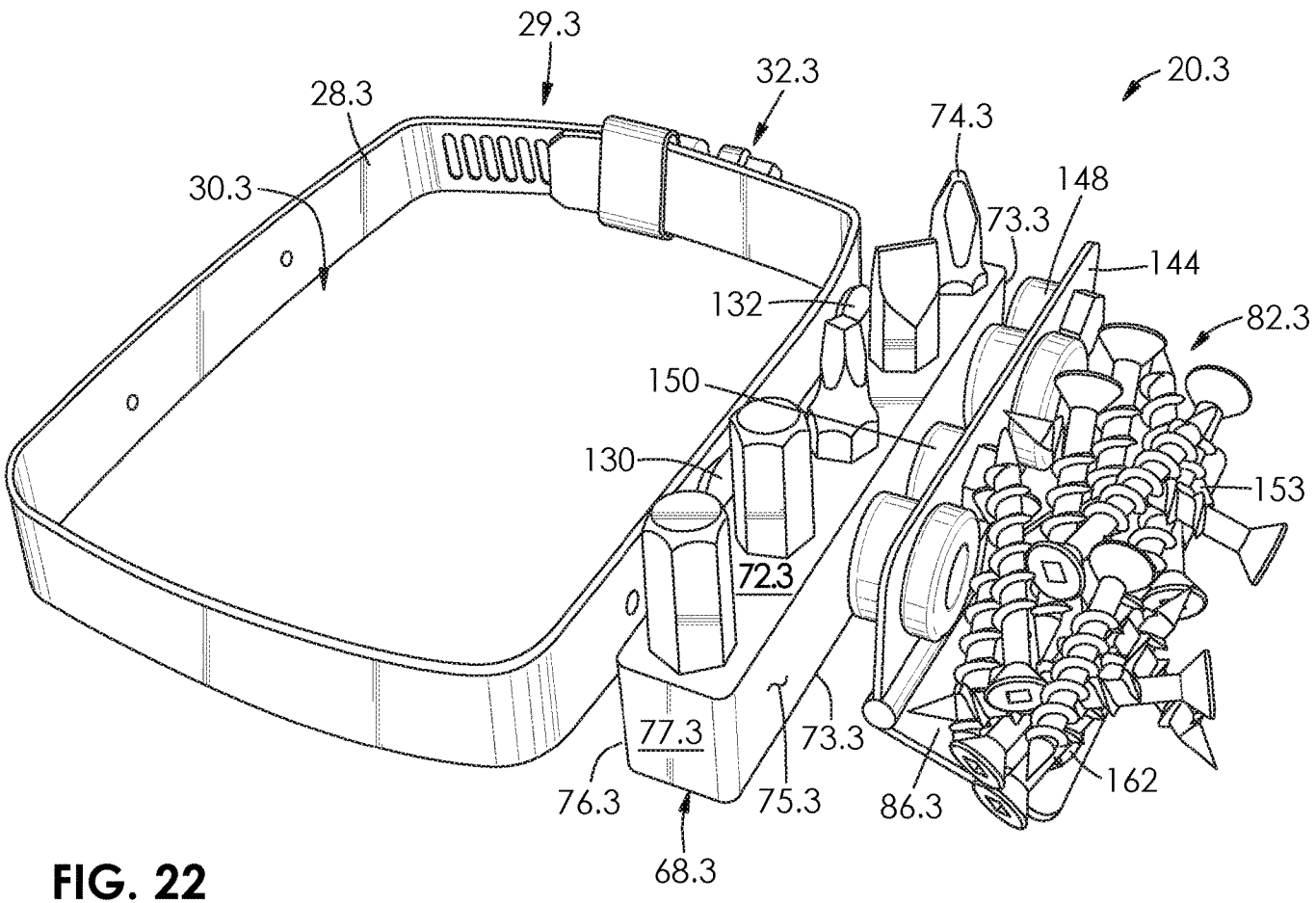
FIG. 22 is a top, side perspective view of the strap of the assembly of FIG. 15, with the bit holder coupled thereto, and with the fastener holder coupled to the bit holder and being shown in a partially unfolded position.

As seen in FIG. 22, the fastener holder 82.3 may be coupled to bit holder 68.3 upside down, with elongate member 146 generally extending outwards from elongate member 144. In this configuration the fastener holder may function as a base support bracket so that a large amount of hardware such as screws, may be stored on the elongate members without falling therefrom.

As seen in FIG. 20, elongate member 146 of fastener holder 82.3 has a pair of spaced-apart apertures 161 and 162 extending therethrough. The apertures are circular in this example, with aperture 162 being adjacent to end 89.3 of the fastener holder 82.3. As seen in FIG. 21, magnets 159 and 160 are shaped to at least partially extend through apertures 161 and 162, respectively, when the fastener holder is in its folded position seen in FIG. 21 in which elongate member 146 abuts elongate member 144. This may enable the fastener holder 93.3 to be folded in a more compact manner, for example. The fastener holder connects to bit holder 68.3 in a manner whereby elongate member 146 is selectively extendable upwards therefrom, as seen in and from the perspective of FIG. 20, or downwards therefrom, as seen in and from the perspective of FIG. 22. In this manner the effective storage area of the fastener holder 82.3 upon which fasteners, bits and the like are magnetically connectable may be effectively enlarged or doubled as needed, and thereafter reduced to a compact form when such an enlarged area is no longer required for a given work task.

Figure 23:
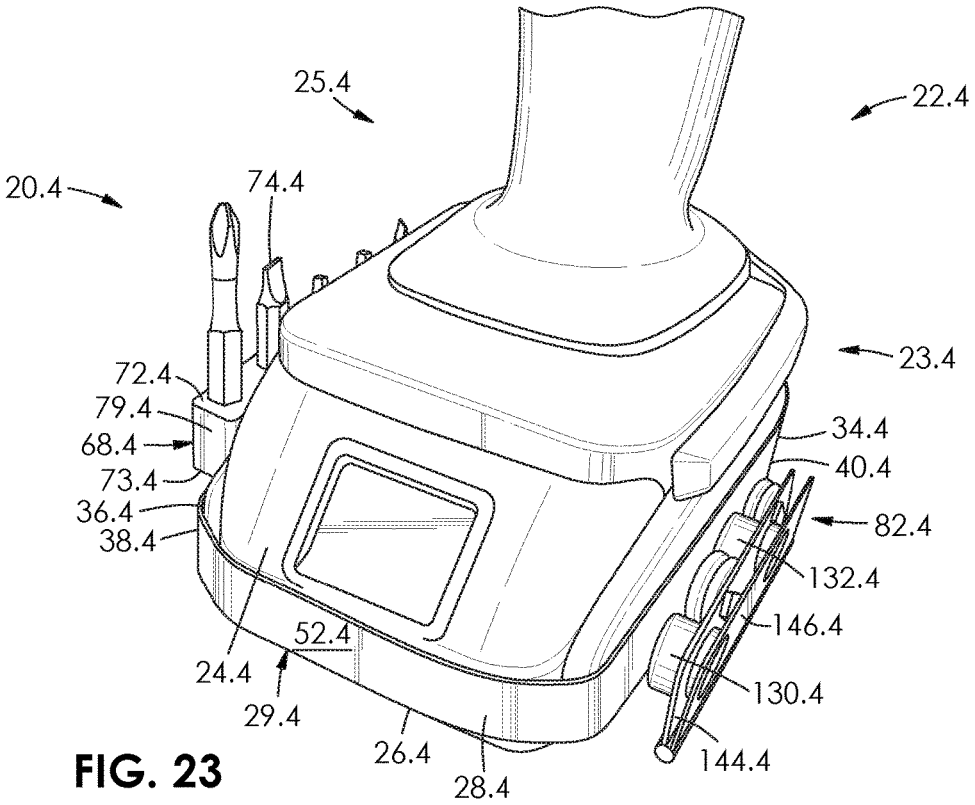
FIG. 23 is a top, front perspective view of a power tool together with a bit and fastener holder assembly connected thereto, according to a fifth aspect, the assembly including a strap, a bit holder coupled to the strap on a first side of the strap, and a fastener holder coupled to the strap on a second side of the strap, the fastener holder being shown in a closed, folded position, and the power tool being shown in fragment.
Figure 24:
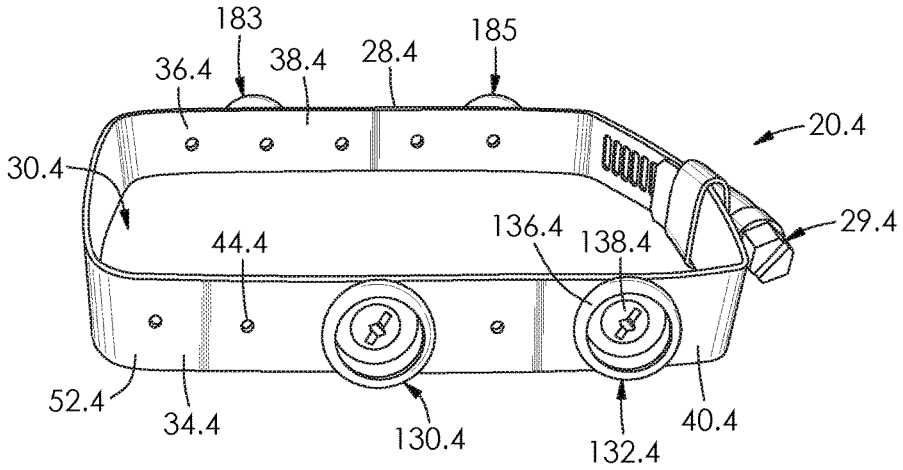
FIG. 24 is a top, side perspective view of the strap of the assembly of FIG. 23.

FIGS. 23 and 24 show a magnetic bit and fastener holder assembly 20.4 according to a fifth aspect for a power tool 22.4. Like parts have like numbers and functions as the assembly 20.3 shown in FIGS. 15 to 22 with decimal extension "0.4" replacing decimal extension "0.3". Assembly 20.4 is substantially the same as the assembly 20.3 shown in FIGS. 15 to 22 with the following exceptions.

As seen in FIG. 24, assembly 20.4 includes a further pair of spaced-apart snap fastener sockets 183 and 185 in this example coupled to and extending outwards from side 38.4 of strap 28.4. The snap fastener sockets are configured to couple with the corresponding snap fastener studs of bit holder 68.4 seen in FIG. 23 in a like manner as described in FIGS. 15 to 22 for assembly 20.3. The bit holder may thus be positioned on side 25.4 of the power tool 22.4 in this embodiment.

Referring to FIG. 24, snap fastener sockets 136.4 extending outwards from side 40.4 of strap 28.4 are configured to receive snap fastener studs of fastener holder 82.4 seen in FIG. 23. The fastener holder may thus be positioned on side 23.4 of the power tool 22.4 in this example.

Straps 28 to 28.4 of FIGS. 1 to 24 so configured may enable assemblies 20 to 20.4 to be universally connectable to and compatible with a large variety of power tools of different types, models, brands and shape.

FIGS. 25 to 29 show a magnetic bit and fastener holder assembly 20.5 according to a sixth aspect for a power tool 22.5. Like parts have like numbers and functions as the assembly 20.3 shown in FIGS. 15 to 22 with decimal extension "0.5" replacing decimal extension "0.3". Assembly 20.5 is substantially the same as the assembly 20.3 shown in FIGS. 15 to 22 with the following exceptions.

Figure 28:
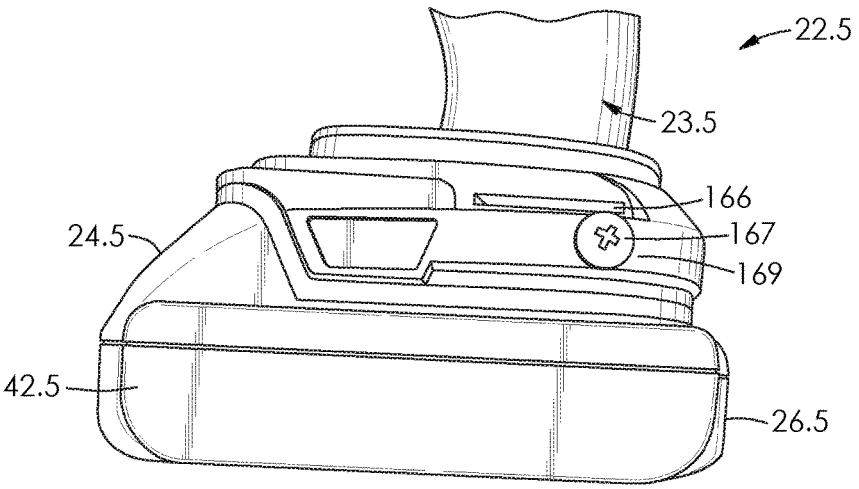
FIG. 28 is a front elevation view of the bottom portion of the power tool of FIG. 25, the power tool being shown in fragment.

As seen in FIG. 28, power tool 22.5 has a slot 166 for receiving a belt clip (not shown). The slot is located adjacent to the bottom portion 24.5 of the power tool 22.5. The slot 166 extends from side 23.5 of the power tool 22.5 towards side 25.5 of the power tool seen in FIG. 25. As seen in FIG. 28, the power tool 22.5 further includes a fastener 167 that is selectively connectable to the power tool at a location 169 adjacent to the slot 166.

Figure 26:
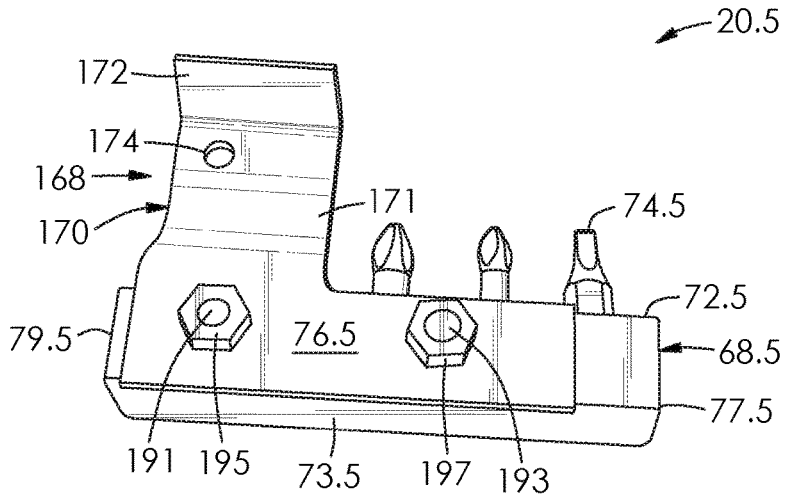
FIG. 26 is a rear, bottom perspective view of the bit holder and bracket of the assembly of FIG. 25.
Figure 27:
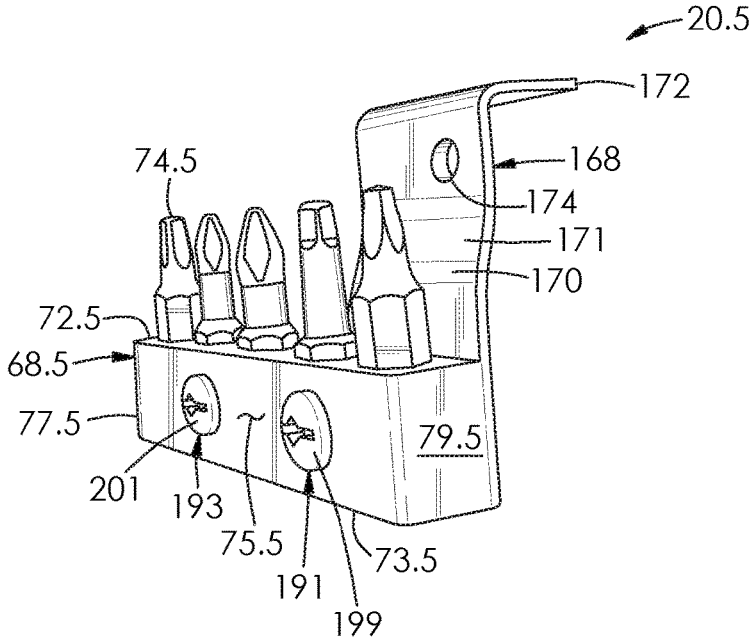
FIG. 27 is a front, side perspective view of the bit holder and bracket of the assembly of FIG. 25.

As best seen in FIGS. 26 and 27, the assembly 20.5 includes a bracket 168 coupled to and extending outwards from the bit holder 68.5. In this example, the bracket couples to and extends from top 72.5 of the bit holder and is adjacent to end 79.5 of the bit holder in this example. Also in this example the bracket 168 couples to the rear 76.5 of the bit holder 68.5 via a pair of spaced-apart fasteners, in this example screws 191 and 193 which threadably couple to female members in the form of nuts 195 and 197. As seen in FIG. 27, the screws have heads 199 and 201 that abut the front 75.5 of the bit holder 68.5 in this example.

Figure 29:
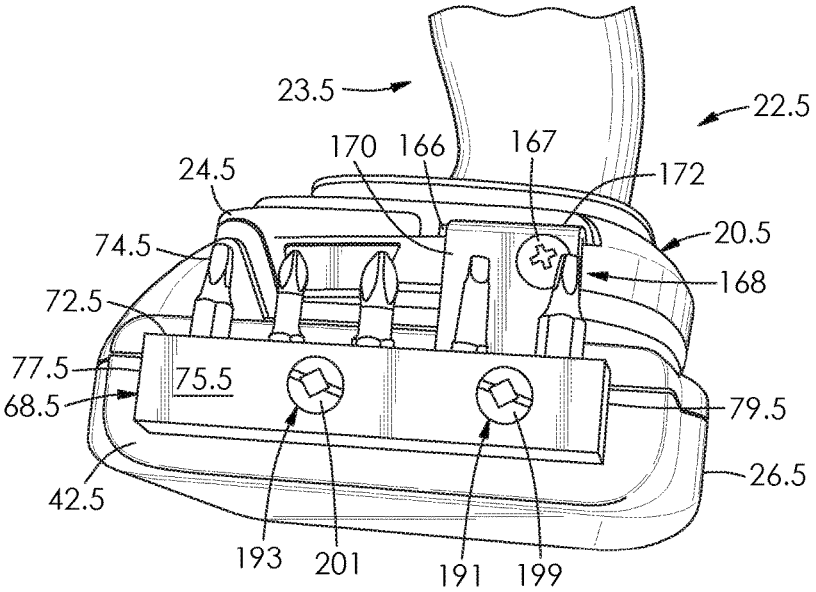
FIG. 29 is a front elevation view of the bottom portion of the power tool of FIG. 25 with the bit holder of FIG. 25 coupled thereto, the power tool being shown in fragment.

The bracket 168 extends from rear 76.5 in this example and is L-shaped in side cross-section, with a vertically-extending portion 170 coupled to and extending from the bit holder and a horizontally-extending portion 172 coupled to and extending outwards from portion 170. As seen in FIG. 29, portion 170 of the bracket 168 longitudinally aligns with and is adjacent to head 199 of screw 191 in this example.

Figure 31:
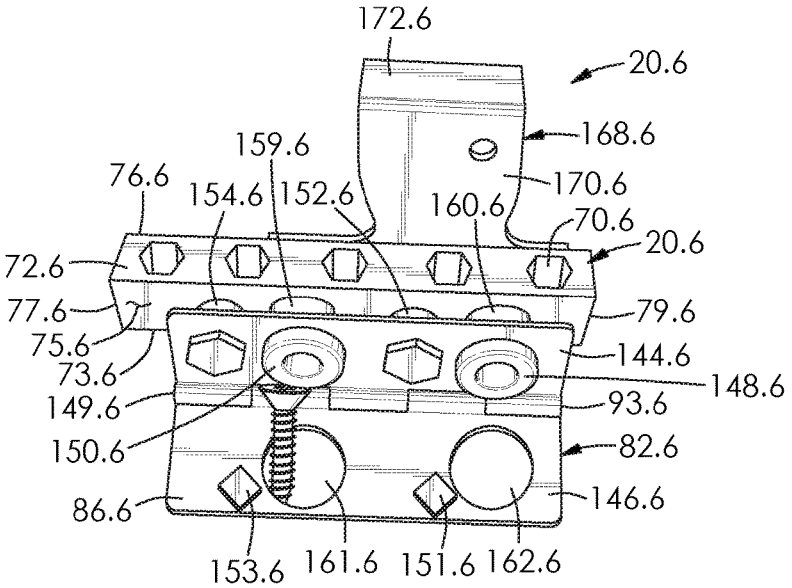
FIG. 31 is a front, top perspective view of the bit holder and bracket of the bit and fastener holder assembly of FIG. 30, with the fastener holder of the assembly being shown coupled to the bit holder and being shown in an open, partially unfolded position.
Figure 32:
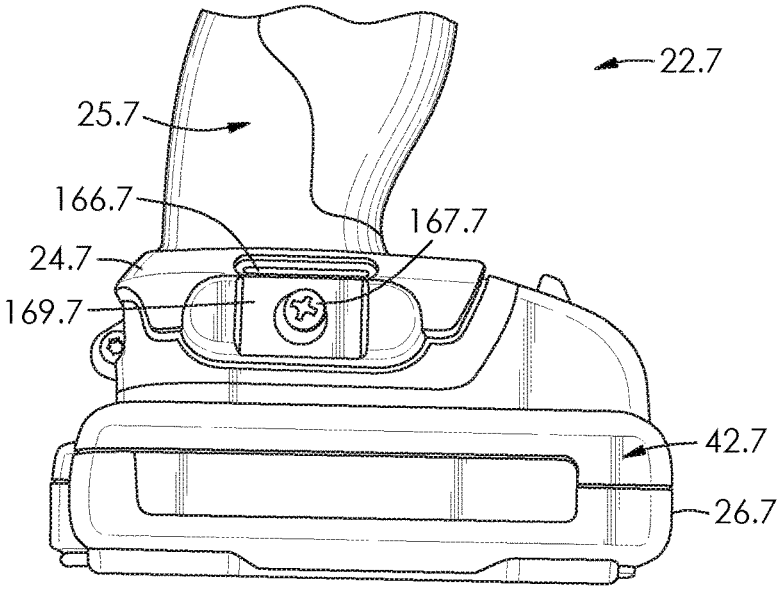
FIG. 32 is a front elevation view of the bottom portion of a power tool for a bit and fastener holder assembly according to an eighth aspect, the power tool being shown in fragment.

Referring to FIG. 31, portion 172 of the bracket is generally a rectangular prism in shape in this example. Portion 172 of the bracket 168 is shaped to be selectively inserted within slot 166, as seen in FIG. 25.

As seen in FIG. 27, portion 170 of the bracket is an elongate s-shape in cross-section and includes an outwardly extending bend 171 as the bracket 168 extends from portion 172 thereof to bit holder 68.5. Portion 170 of the bracket is slightly outwardly concave and has an aperture 174 extending therethrough. As seen in FIG. 29, portion 170 of the bracket 168 is shaped to extend laterally upwards from and perpendicular to battery pack 24.5 in this example. Portion 170 of the bracket is selectively connectable to the power tool 22.5 via fastener 167, a screw in this example, which partially extends through aperture 174 seen in FIG. 27 and threadably connects to the power tool. The bracket 168 is thus shaped to position bit holder 68.5 adjacent to and along side 42.5 of the battery pack 24.5.

Heads 66.5 of bolts 62.5 and 64.5 may be used for connecting other holders thereon, such as fastener holder 82.3 seen in FIG. 22 in a manner substantially similar as has been previously described.

Figure 25:
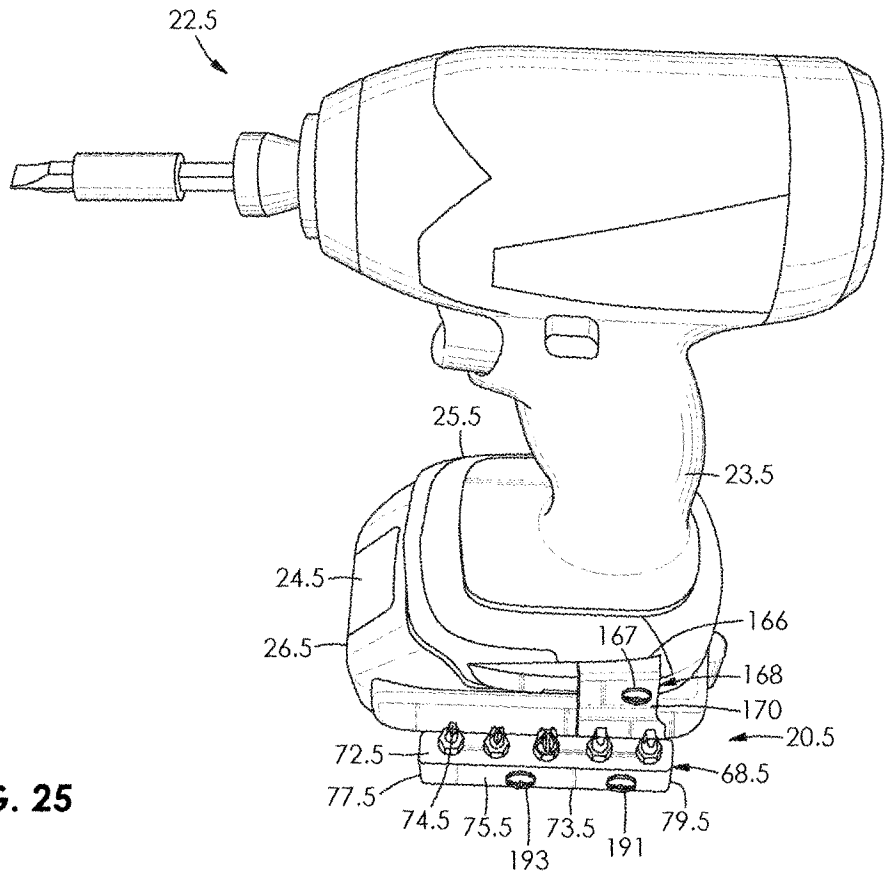
FIG. 25 is a top, side perspective view of a power tool together with a bit and fastener holder assembly connected thereto, according to a sixth aspect, the assembly including a bit holder and a bracket connecting the bit holder and the power tool together.
Figure 30:
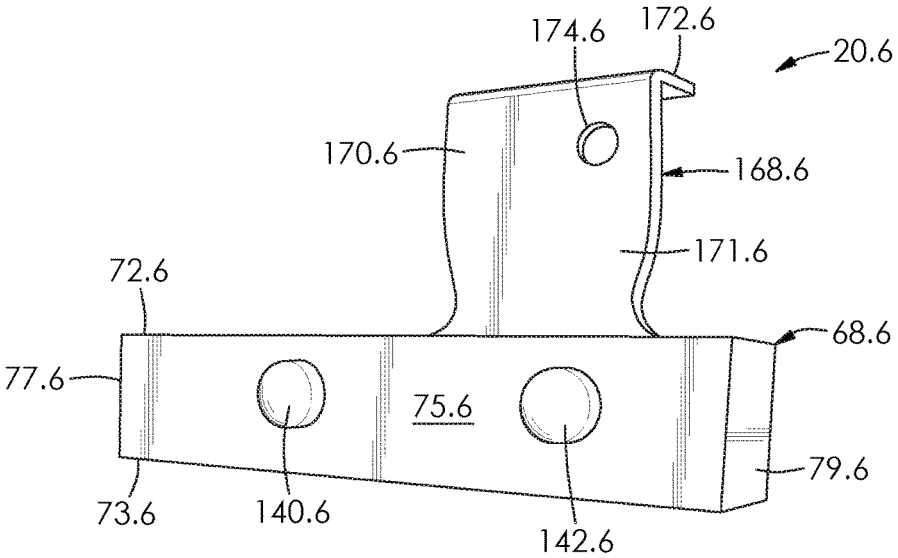
FIG. 30 is a front, side perspective view of a bit holder and bracket of a bit and fastener holder assembly according to a seventh aspect, with a fastener holder thereof not being shown.

FIGS. 30 and 31 show a magnetic bit and fastener holder assembly 20.6 according to a seventh aspect for the power tool 22.5 seen in FIG. 25. Like parts have like numbers and functions as the assembly 20.5 shown in FIGS. 25 to 29 with decimal extension "0.6" replacing decimal extension "0.5". Assembly 20.6 is substantially the same as the assembly 20.5 shown in FIGS. 25 to 29 with the exception that bit holder 68.6, seen in FIG. 30, has a pair of spaced-apart knobs 140.6 and 142.6 extending from front 75.6 thereof, with the knobs being substantially similar to knobs 140 and 142 seen in FIG. 18 for assembly 20.3. The knobs selectively couple with washers 148.6 and 150.6 of fastener holder 82.5 seen in FIG. 31.

FIGS. 32 to 36 show a magnetic bit and fastener holder assembly 20.7 and a power tool 22.7 according to an eighth aspect. Like parts have like numbers and functions as the assembly 20.5 shown in FIGS. 25 to 29 with decimal extension "0.7" replacing decimal extension "0.5". Assembly 20.7 is substantially the same as the assembly 20.5 shown in FIGS. 25 to 29 with the following exceptions.

Figure 33:
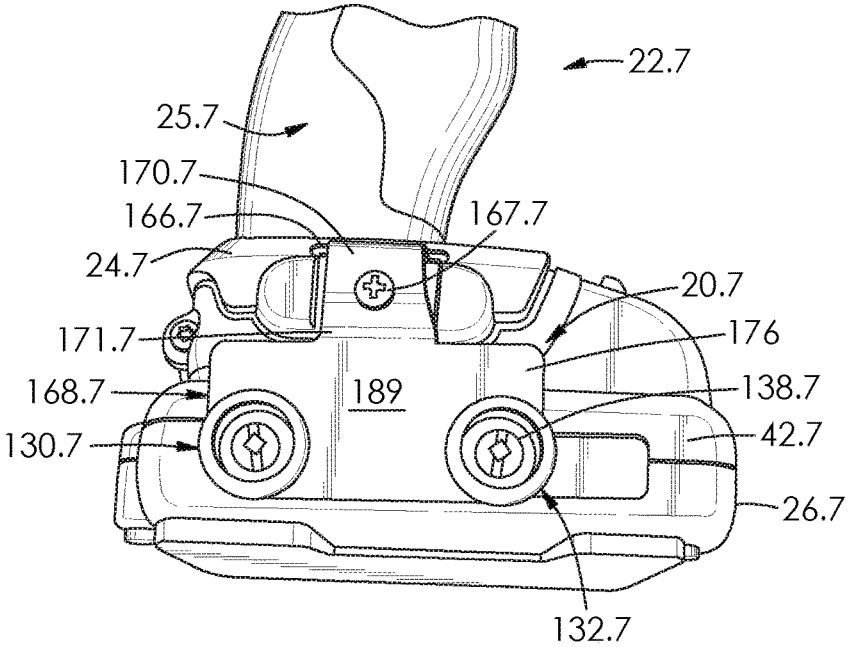
FIG. 33 is a front elevation view of the bottom portion of the power tool of FIG. 32 and a bracket of the bit and fastener holder assembly according to the eighth aspect coupled thereto, the power tool being shown in fragment.
Figure 35:
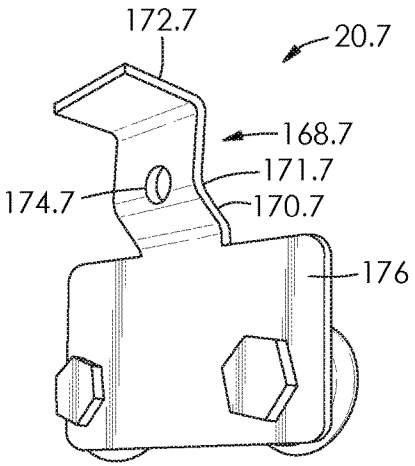
FIG. 35 is a rear, side perspective view of the bracket of the assembly of FIG. 32.
Figure 34:
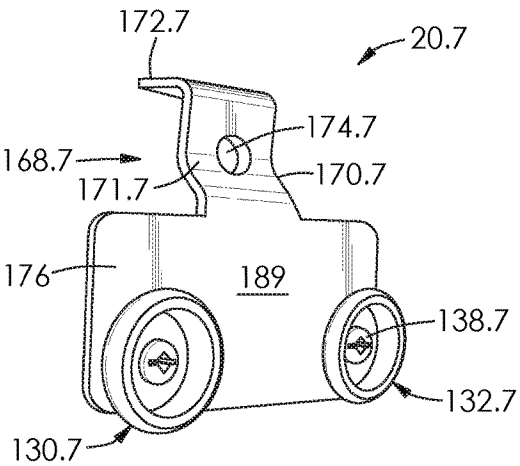
FIG. 34 is a front, side perspective view of the bracket of the assembly of FIG. 32.
Figure 36:
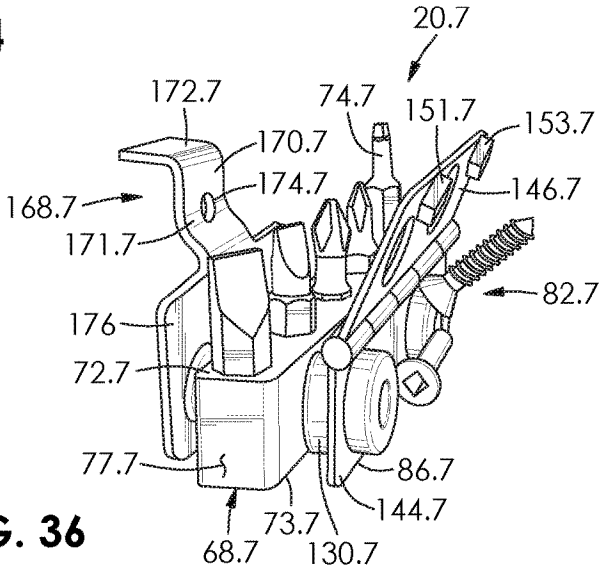
FIG. 36 is a front, side perspective view of the bracket of the assembly of FIG. 32, with a bit holder connected thereto and a fastener holder coupled to the bit holder.

As seen in FIG. 34, bracket 168.7 is T-shaped in this example in front profile. Referring to FIG. 33, the bracket includes a lower portion 176 that is a plate-like rectangular prism in shape in this example which aligns with and generally extends in parallel with side 42.7 of battery pack 24.7 as shown in FIG. 33. Assembly 20.7 includes a pair of spaced-apart connectors, in this example female members, in this case snap fastener sockets 130.7 and 132.7 coupled to and extending outwards from an outer surface 189 of portion 176 of the bracket 168.7 The snap fastener sockets enable bit holder 68.7 or fastener holder 82.7 seen in FIG. 36 to selectively couple to bracket 168.7 via respective ones of the corresponding snap fastener studs of the holders. The manner in which the bit holder and fastener holder otherwise connect and operate is substantially similar to that described in FIGS. 15 to 22 and thus will not be described in further detail.

Portion 170.7 of bracket 168.7 is integrally connected to, integrally formed with and extends upwards from portion 176 of the bracket in this example. Portion 170.7 of the bracket couples to portion 172.7 of the bracket. As seen in FIG. 34, portion 170.7 of the bracket is an elongate s-shape in cross-section in this example and includes a bend 171.7 as the bracket 168.7 extends from portion 172.7 thereof downwardly to bit holder 68.7. Portion 170.7 of the bracket has an aperture 174.7 extending therethrough for receiving fastener 167.7, which threadably couples bracket 168.7 to the bottom portion 26.7 of power tool 22.7.

Portion 170.7 of bracket 168.7 is centrally disposed relative to and extends upwards from portion 176 of the bracket in this example. As seen in FIG. 33, snap fastener sockets 130.7 and 132.7 are positioned on portion 176 of the bracket to the left and right, respectively, of portion 170.7 of the bracket and slot 166.7 in this example.

The magnets described herein are rare earth, strong magnets in this example. However, this is not strictly required and other magnets may be used in other embodiments.

It will be appreciated that many variations are possible within the scope of the invention described herein. For example, while the assemblies described herein disclose male members extending from the mounting member, such male members may alternatively directly extend from the strap. As a further alternative, female members may couple to the mounting member and/or strap and protrusions may couple to and extend from the bit holders, for example.

Also, when the male and female members are described in the form of snap fasteners, they are strong, marine grade, stainless steel snaps in this example; however, this is not strictly required. For example, if a strong snap attachment is desired, one-way snaps may be used for example, which are configured to separate when pulled away from each other in one particular direction.

As seen in FIG. 15, the coupling fastener holder 82.3 to bit holder 68.3 may result in the other side of the battery being free for users who may prefer a power tool configured in this manner. It also allows the user to use one of the assemblies 20.5 to 20.7 on the other side of the power tool if desired, for example.

It will be understood by someone skilled in the art that many of the details provided above are by way of example only and are not intended to limit the scope of the invention which is to be determined with reference to at least the following claims.

What is claimed is:

1. A bit holder assembly for connecting to a bottom portion of a power tool, the assembly comprising:

a bracket shaped to couple to the power tool;

a bit holder having a top, a plurality of longitudinally spaced-apart sockets extending downwards from said top, a front that faces outwards from the power tool when connected thereto, and a rear opposite the front thereof, the rear of the bit holder coupling to the bracket; and a fastener holder coupled to the front of the bit holder, the fastener holder including a pair of elongate members hingedly connected together, and the fastener holder being moveable from a folded position, in which the elongate members substantially overlie each other, to an unfolded position in which the elongate members are angularly spaced-apart relative to each other.

2. The bit holder assembly as claimed in claim 1 wherein the bit holder is a rectangular prism in shape.

3. In combination, a power tool and the bit holder assembly as claimed in claim 1.

4. The bit holder assembly as claimed in claim 1 wherein the bracket is L-shaped.

5. The bit holder assembly as claimed in claim 1 wherein the bracket is t-shaped.

6. The bit holder assembly as claimed in claim 1, further including a fastener which couples the bracket to the power tool.

7. The bit holder assembly as claimed in claim 1 further including a snap fastener, the bit holder coupling to the bracket via said snap fastener.

8. The bit holder assembly as claimed in claim 1 wherein the bit holder includes a first one of a male member and a female member disposed along the front thereof, and wherein the fastener holder includes a second one of the male member and the female member which selectively couples to said first one of the male member and the female member of the bit holder.

9. The bit holder assembly as claimed in claim 1, wherein each said socket is shaped to receive a respective bit having a bit width, wherein each said socket has a socket width which is larger that said bit width and wherein the bit holder further including a plurality of magnets disposed within respective ones of said sockets.

10. The bit holder assembly as claimed in claim 1, the power tool having a side and a battery pack, and wherein the bit holder is a rectangular prism in shape, configured to selectively connect to the battery back of the power tool at the side of the power tool, and shaped to extend along and in parallel with the side of the power tool.

11. The bit holder assembly as claimed in claim 1, wherein the sockets are configured to receive a plurality of bits, and wherein the bit holder includes a plurality of magnets disposed within respective ones of said sockets for selectively magnetically coupling to said bits.

12. The bit holder assembly as claimed in claim 1, the power tool having a slot for receiving a belt clip adjacent to the bottom portion thereof, and wherein the bracket is shaped to couple to the power tool via the slot.

13. The bit holder assembly as claimed in claim 1, wherein the fastener holder couples to the front of the bit holder via a first one of said elongate members and wherein the fastener holder connects to the bit holder in a manner whereby a second one of the elongate members is selectively extendable upwards therefrom.

14. The bit holder assembly as claimed in claim 1, wherein the fastener holder couples to the front of the bit holder via a first one of said elongate members and wherein the fastener holder connects to the bit holder in a manner whereby a second one of the elongate members is selectively downwards therefrom.

15. A foldable fastener holder for a power tool, the fastener holder comprising:

a pair of elongate members hingedly connected together, the elongate members being moveable from a folded position, in which the elongate members substantially overlie each other, to an unfolded position in which the elongate members are angularly spaced-apart relative to each other, a first of the elongate members having at least one aperture extending therethrough; and at least one magnet coupling to a second of the elongate members, the at least one magnet being shaped to at least partially extend through the at least one aperture of the first of the elongate members when the elongate members are in the folded position.

16. The fastener holder as claimed in claim 15, wherein each of the elongate members is a generally rectangular, flat and rigid plate of metal which is ferromagnetic.

17. The fastener holder as claimed in claim 15, further including at least one magnet coupling to the first of the elongate members.

18. The fastener holder as claimed in claim 15, wherein the elongate members are ferromagnetic, wherein the fastener holder has an effective storage area and is configured such that fasteners and bits are magnetically connectable thereto, and wherein a first of the elongate members is selectively extendable upwards or downwards from a second of the elongate members, whereby the effective storage area of the fastener holder being effectively enlarged as needed and is thereafter reducible to a compact form when such an enlarged are is no longer required for a given work task.

19. A foldable fastener holder for a power tool, the fastener holder comprising:

a pair of elongate members hingedly connected together, the elongate members being moveable from a folded position, in which the elongate members substantially overlie each other, to an unfolded position in which the elongate members are angularly spaced-apart relative to each other;

a pair of spaced-apart magnets coupled to a first of the elongate members; and at least one magnet coupled to a second of the elongate members, the at least one magnet of the second of the elongate members being interposed between the magnets of the first of the elongate members when the pair of elongate members are in the folded position.

20. The fastener holder as claimed in claim 19, wherein the first of the elongate members has a peripheral edge portion and wherein the magnets of the first of the elongate members align along said peripheral edge portion.

* * * * *